US005695441A

United States Patent [19]

Irikura

[11] Patent Number: 5,695,441

[45] Date of Patent: Dec. 9, 1997

[54] FILTER PLUG FEEDING APPARATUS FOR A FILTER CIGARETTE MANUFACTURING MACHINE

[75] Inventor: Takayuki Irikura, Tokyo, Japan

[73] Assignee: Japan Tobacco Inc., Tokyo, Japan

[21] Appl. No.: 413,390

[22] Filed: Mar. 30, 1995

[30] Foreign Application Priority Data

Mar. 31, 1994 [JP] Japan ..... 6-063709

[51] Int. Cl.[6] ..... A24C 5/52; A24D 3/02

[52] U.S. Cl. ..... 493/47; 493/39; 493/941

[58] Field of Search ..... 493/46, 47, 48, 493/50, 45, 39; 131/74

[56] References Cited

U.S. PATENT DOCUMENTS 4,867,734 9/1989 Okumoto et al. ..... 493/48

*Primary Examiner*—Joseph J. Hail, III
*Assistant Examiner*—Anthony Ojini

[57] ABSTRACT

A filter plug feeding apparatus comprises a pair of hoppers in which charcoal and plain filter rods are stored, a pair of hopper drums for delivering charcoal and plain filter rods from the hoppers, respectively, the hoppers being able to discharge the filter rods in a manner such that the axial centers of the filter rods are situated individually on feeding lines for their corresponding hopper drums and the delivered filter rods being cut into a pair of filter half rods on the hopper drums, a separation drum for separate a pair of charcoal half rods received from one hopper drum, an assembly drum for receive the pair of charcoal half rods the from the separation drum and a pair of plain half rods from the other hopper drum, and rotary knives detachably attached to the assembly drum and capable of cutting each of the charcoal half rod into a pair of charcoal plugs.

10 Claims, 28 Drawing Sheets

SEPARATION DRUM

FILTER PLUG FEEDING APPARATUS FOR A FILTER CIGARETTE MANUFACTURING MACHINE

BACKGROUND OF THE INVENTION

1. Field of the Invention

The present invention relates to a filter plug feeding apparatus incorporated in a filter cigarette manufacturing machine, and more particularly, to an apparatus adapted for the feed of filter plugs of various types.

2. Description of the Related Art

A typical example of a filter cigarette manufacturing machine or a so-called filter attachment is disclosed in U.S. Pat. No. 4,867,734. This conventional filter attachment is provided with a filter plug feeding apparatus, which forms dual filter plugs, and feed the formed filter plugs to grooved drums which constitute a transportation path of the filter attachment. The transportation path is used to transport pairs of cigarettes in the filter attachment.

More specifically, the feeding apparatus comprises a pair of hoppers, which are stored individually with charcoal filter rods and plain filter rods. The charcoal and plain filter rods delivered from the pair of hoppers are transferred toward the transportation path. In this process of transfer, various operations, such as cutting, separation, joining, grading, orientation, etc., are carried out. At the end of the transfer process, dual filter plugs are formed each having one plain plug and a pair of charcoal tips situated individually on the opposite sides thereof. Each dual filter plug formed in this manner is fed to the transportation path, and is located between a pair of cigarettes on this transportation path. Plain plugs and charcoal tips are obtained by cutting plain filter rods and charcoal filter rods, respectively.

In the filter attachment, thereafter, the pair of cigarettes and the dual filter plug are connected to one another by means of a tip paper piece, whereupon a double filter cigarette which is equivalent to two filter cigarettes is formed. The double filter cigarette is cut into two equal parts or filter cigarettes.

The conventional filter plug feeding apparatus is applicable only to the formation and feed of dual filter plugs, and cannot be used for the formation and feed of non-dual filter plugs, such as plain filter plugs, triple filter plugs, or recessed filter plugs.

In the case where non-dual filter cigarettes are manufactured by means of the filter attachment, therefore, a feeding apparatus for dual filter plugs must be replaced with one for non-dual filter plugs. However, the replacement of the whole feeding apparatus is not very easy, requiring much labor and long time or many days.

The operation of the filter attachment is suspended during the replacement work, so that the productivity of filter cigarettes is lowered. As the operating speed of modern filter attachments increases, the reduction of the productivity caused by the suspension of the operation becomes more serious.

Since the replacement is a hard task, the filter attachment cannot easily cope with the change of the brand of filter cigarettes to be manufactured. Accordingly, the filter attachment cannot be operated efficiently, and cannot meet varied demands for the filter cigarettes.

Moreover, a plurality of filter plug feeding apparatuses of different types must be provided for each filter attachment in advance. This provision entails a heavy investment, and off-duty feeding apparatuses require additional storage and maintenance.

SUMMARY OF THE INVENTION

The object of the present invention is to provide a filter plug feeding apparatus applicable to the formation and feed of filter plugs of different types and capable of easily coping with the change of the filter plugs to be fed.

The above object is achieved by a feeding apparatus of the present invention, which comprises a first and second hoppers which are stored with filter rods, a drum train connecting respective discharge ports of the first and second hopper and a transportation path for cigarettes and used to form filter plugs from the filter rods in the first and second hoppers and feed the formed filter plugs to the transportation path.

More specifically, the drum train includes a first feeding line for delivering first-type filter rods one by one from the discharge port of the first hopper and feeding the delivered first-type filter rods, a second feeding line for delivering second-type filter rods one by one from the discharge port of the second hopper and feeding the delivered second-type filter rods, and a third feeding line for connecting ends of the first and second feeding lines and the transportation path, the third feeding line receiving the filter rods or parts thereof from the first and second feeding lines and feeding the filter rods or parts toward the transportation path.

The feeding apparatus of the invention further comprises adapting means for adapting the first and second feeding lines to form dual filter plugs and non-dual filter plugs, respectively. Here, the dual filter plug has a center element or a plain plug, and a pair of tip elements or charcoal tips situated individually on the opposite sides thereof, and the non-dual filter plug has an element such as a plain filter plug, triple filter plug or recessed filter plug.

According to the feeding apparatus described above, the adapting means allows the first and second feeding lines to use in common for the formation of the dual or non-dual filter plugs. Thus, change of the operation of the feeding apparatus between modes for dual and non-dual filter plugs requires only simple operation and very short time. As a result, the operating efficiency of a filter cigarette manufacturing machine is improved, and changes of demand for filter cigarettes of different brands can be coped with.

More specifically, the adapting means may include centering means for locating the respective axial centers of the filter rods on the first and second feeding lines, respectively, when the filter rods are delivered from said first and second hoppers onto the drum train. In this case, regardless of the lengths of the first- and second-type filter rods stored in the first and second hoppers for the formation of the dual or non-dual filter plugs, the centering means can accurately locate the respective axial centers of the first- and second type filter rods on the corresponding feeding line when the first-and second-type filter rods are discharged from the first and second hoppers to the drum train. Thereafter, the first- and second type filter rods are carried along the corresponding feeding line toward the third feeding line. This means that the first and second feeding lines can be used in common for the feeding of the first- and second type filter rods and the formations of dural and non-dual filter plugs. centering means for locating the respective axial centers of the filter rods on the first and second feeding lines, respectively, when the filter rods are delivered from the first and second hoppers onto the drum train.

The centering means can be easily obtained by providing each hopper with a pair of hopper walls which face each other so as to be movable toward and away from each other. Accordingly, the distance between the hopper walls of each hopper, that is, the size and center of the discharge port of the hopper, can be adjusted depending on the length of the filter rods to be stored in the hopper. Thus, the respective centers of the filter rods discharged from each hopper can be accurately located on the corresponding feeding line of the drum train.

The drum train may includes a separating drum section connected to the discharge port of the first hopper, the separating drum section including the first feeding line and part of the third feeding line, and designed so that each of the first-type filter rods is cut equally into a pair of first-type half rods in the process of the feeding, and the pair of first-type half rods are then separated from each other in the axial direction thereof, cutting means for cutting each first-type half rod on the separating drum section into a pair of first-type plugs, the cutting means including two rotary knives allowed to detach from the first feeding line, a joining drum section for connecting the discharge port of the second hopper and the separating drum section, the joining drum section including the second feeding line, and designed so that each of the second-type filter rods is cut equally into a pair of second-type half rods in the process of the feeding, and the pair of second-type half rods are then situated between the pairs of first-type plugs on the separating drum section, whereby a first rod group is formed on the separating drum section, the first rod group including the pair of second-type half rods and the pairs of first-type plugs located on the opposite sides thereof.

In the case where the first-type filter rods and the second-type filter rods are charcoal filter rods and plain filter rods, respectively, the first rod group can form a dual filter plug or an intermediate product thereof.

If the first and second filter rods in the first and second hoppers are of the same type and have the same length, however, the rotary knives of the cutting means are detached from the first feeding line. Since the individual first-type half rods fed on the separating drum section are not cut, in this case, the first rod group includes a pair of first-type half rods separated from each other and a pair of second-type half rods situated between them, and each of these half rods can form a non-dual filter plug of an intermediate product thereof.

More specifically, the separating drum section includes a first hopper drum rotatably disposed adjacent to the discharge port of the first hopper and adapted to deliver the first-type filter rods one by one from the first hopper, a rotary knife attached to the first hopper drum and adapted to cut each delivered first-type filter rod into a pair of first-type half rods on the first hopper drum, a separation drum rotatably disposed adjacent to the first hopper drum and adapted to receive the pair of first-type half rods from the first hopper drum and separate the received first-type half rods from each other, and an assembly drum rotatably disposed adjacent to the separation drum and adapted to receive the pair of first-type half rods from the separation drum. In this case, the joining drum section includes a second hopper drum rotatably disposed adjacent to both the discharge port of the second hopper and the assembly drum and adapted to deliver the second-type filter rods one by one from the second hopper toward the assembly drum, and a rotary knife attached to the second hopper drum and adapted to cut each delivered second-type filter rod into a pair of second-type half rods on the second hopper drum.

The cutting means may include a supporting arm disposed for rocking motion above the first feeding line and rotatably supporting the pair of rotary knives and a power transmission path for transmitting power to the rotary knives. Preferably, in this case, a coupling is inserted in the middle of the power transmission path.

In the case where the feeding apparatus is applied to the formation and feed of non-dual filter plugs, the supporting arm of the cutting means is rocked, so that the pair of rotary knives are detached from the first feeding line. If the power transmission path for the rotary knives is separated from the coupling at this time, the rotation of the knives, which are off duty, can be stopped.

The drum train may further includes grading means for receiving the first rod groups from the separating drum section, separating each of the first rod groups into two second rod groups in the feeding direction thereof, and carrying the second rod groups, each of the second rod groups including one second-type half rod and a pair of first-type plugs located individually on the opposite sides thereof, or one first-type half rod and one second-type half rod arranged on the side of first-type half rod, and orientation means for receiving each second rod group and drawing up the components in the received second rod group.

More specifically, the grading means comprises a rotatable grading drum connected to the assembly drum, and the orientation means comprises an aligning drum rotatably located adjacent to the grading drum.

In this case, each of the grading and aligning drums includes a fixed sleeve, a rotatable drum shell removably mounted on the outer peripheral surface of the sleeve, and a grooved ring fixedly mounted on the outer peripheral surface of the drum shell, the grooved ring having on the outer peripheral surface thereof a plurality of feeding grooves capable of receiving the components in the second rod group to be fed.

More specifically, each of the grading and aligning drums further includes suction means for retaining the components in the feeding grooves by suction, and the suction means has a plurality of suction slots formed in the outer peripheral surface of the sleeve and adapted to supplied with a suction pressure and a plurality of suction holes each having one end opening in the base of each of the feeding grooves and the other end connectable with each corresponding suction slot, the suction holes radially extending in the drum shell and the grooved ring.

According to the grading drum and the aligning drum described above, the respective drum shells of the grading and aligning drums, along with the grooved rings thereof, are replaced when the operation mode of the feeding apparatus is changed.

The drum train may further include a third drum section for feeding the components in the second rod group drawn up by the orientation means to the transportation path; second cutting means for equally cutting each of the components into equal numbers of elements, respectively, the second cutting means including a plurality of rotary knives allowed to detach from the third feeding line, whereby the second rod group is divided into first plug groups on the third drum section.

In this case, each of the first plug groups includes a plurality of second-type plugs situated in the center and a plurality of first-type tips arranged individually on the opposite sides of the set of second-type plugs, or a plurality of first-type plugs and a plurality of second-type plugs arranged on the side of the set of first-type plugs. These first-type plugs or tips has been obtained by cutting the first-type half rod or the first-type plug, and the second-type plugs has been obtained by cutting the second-type half rod.

The drum train further includes second grading means for separating the each of the first plug groups into a plurality of second plug groups or non-dual filter plugs in the feeding direction, each of the second plug groups including one second-type plug and a pair of first-type tips arranged individually on the opposite sides of the second-type plug and the non-dual filter plug being any one of first- and second type plug, and second orientation means for receiving the second plug groups or non-dual filter plugs and drawing up the elements in the received second plug groups and non-dual filter plug, whereby the elements in the second plug group form a dual filter plug. Thereafter, the dual filter plug or non-dual filter plug is fed in the transportation path.

In this case, most of arrangements of the feeding apparatus can be used in common for the formation and feed of the dual or non-dual filter plugs.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION OF THE PREFERRED EMBODIMENTS

Figure 1:
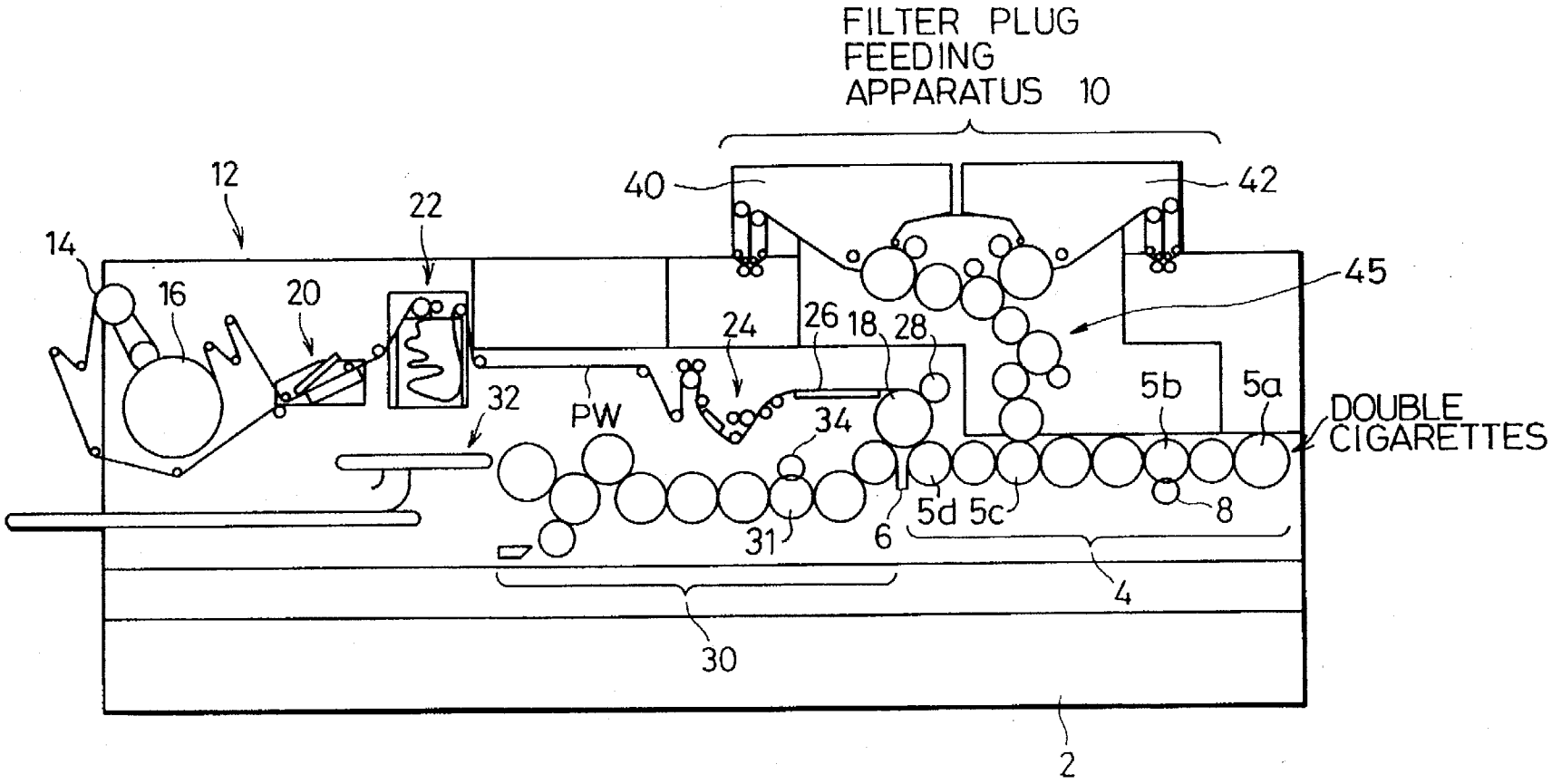
FIG. 1 is a schematic front view showing a filter attachment.

Referring to FIG. 1, a filter cigarette manufacturing machine or filter attachment comprises a main frame 2. In FIG. 1, a drum train 4 is provided at the right-hand portion of the main frame 2, and extends from the right-hand end of the main frame 2 to a wrapping section 6. The drum train 4 includes a plurality of grooved drums, which have a large number of grooves (not shown) each. These grooves are arranged at regular intervals on the outer peripheral surface of each drum. A grooved drum 5*a*, which is located at the right-hand end of the drum train 4 as shown in FIG. 1, can receive double cigarettes by means of its grooves, individually, as it rotates. Each double cigarette, which is manufactured by means of a cigarette manufacturing machine (not shown), has a length twice that of each cigarette which is used in a filter cigarette.

When each grooved drum rotates in a conventional manner, double cigarettes which are fed to the right-hand end of the drum train 4 transfer in succession to the adjacent grooved drums on the left-hand side as they are transported toward the wrapping section 6. Another grooved drum 5*b* in the drum train 4 is provided with a rotary knife 8. As each double cigarette on the grooved drum 5*b* passes the knife 8, the knife 8 cuts the double cigarette into equal parts. As a result, two single cigarettes are obtained from one double cigarette in a manner such that they are situated coaxially with each other. As the two single cigarettes are transported toward the wrapping section 6, they are separated from each other in the axial direction thereof, whereby a predetermined space is secured between them.

Figure 2:
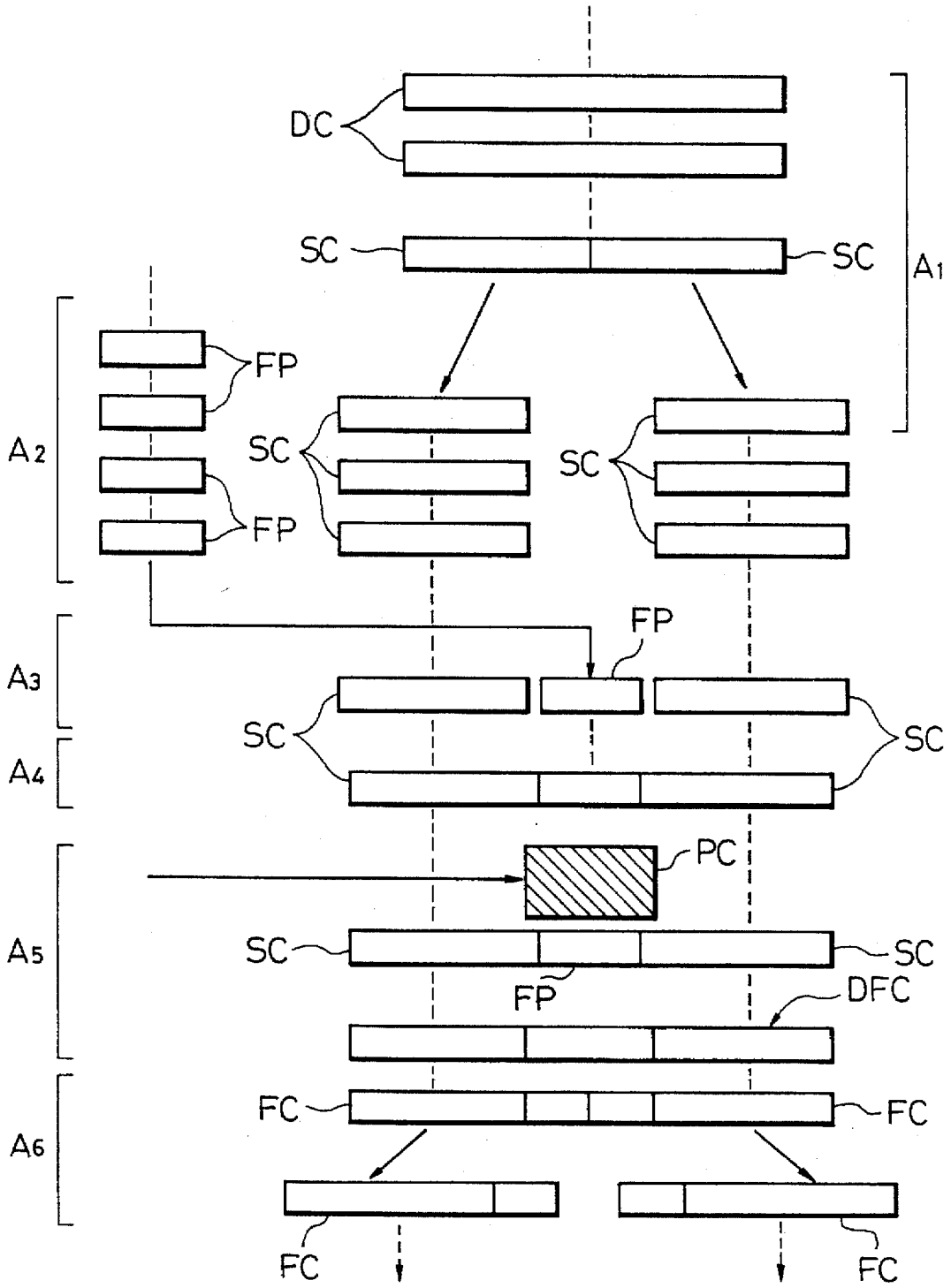
FIG. 2 is a diagram showing the flow of filter cigarette manufacturing processes in the filter attachment of FIG. 1.

In FIG. 2, a region $A_1$ corresponds to processes in which two single cigarettes SC are formed from a double cigarette DC, and the predetermined space is secured between the single cigarettes SC.

As shown in FIG. 1, a filter plug feeding apparatus 10 is located over the drum train 4. The feeding apparatus 10 feeds filter plugs one after another to the drum train 4, and supplies each filter plug to the space between the two single cigarettes SC which are transported coaxially with each other on a grooved drum 5*c* in the drum train 4. Thereafter, the filter plug and the two single cigarettes SC are transported toward the wrapping section 6 on the drum train 4. The feeding apparatus 10 will now be described in detail.

In FIG. 2, a region $A_2$ corresponds to a process in which filter plugs FP are fed toward the drum train 4, while a region $A_3$ corresponds to a state in which a filter plug FP is interposed between the two single cigarettes SC. The filter plug FP has a length twice that of each filter tip which is to be attached to a single cigarette SC.

When the two single cigarettes SC, which are transported together with the filter plug FP on the drum train 4, pass a grooved drum 5*d* which is situated at the terminal of the drum train 4, they are moved in their axial direction so that they come intimately into contact with the opposite ends of the filter plug FP, individually. This state is represented by a region $A_4$ in FIG. 2.

As is evident from the above description, the drum train 4 serves successively to transfer cigarette groups, each including two single cigarettes Sc and one filter plug FP, to the wrapping section 6.

Besides the cigarette groups, paper pieces are fed in succession to the wrapping section 6. Paste is applied to one side of each paper piece. A paper piece feeding apparatus 12 is provided with a pair of web rolls 14 and 16, which are located over the left-hand end of the main frame 2. A paper PW delivered from the working web roll 14 is guided along a guide path, which is formed of a large number of guide rollers, to a suction drum or receiving drum 18. The receiving drum 18 is located near the wrapping section 6 with an edged drum 28.

Successively arranged in the guide path for the paper PW, from the upper stream side thereof to the lower stream side, are a connecting device 20 for changing the working web roll, a reservoir 22 for the paper PW, a device 24 for applying the paste to one side of the paper PW, and a drier 26 for preliminarily drying the applied paste.

As the receiving drum 18 and the edged drum 28 rotate, the paper PW on the receiving drum 18 is cut into individual paper pieces PC having a predetermined length, and these paper pieces PC are fed in succession to the wrapping section 6.

In the wrapping section 6, a paper piece PC is wound like a ring around the center of one cigarette group received from the drum train 4, whereby the single cigarettes and the filter plug are connected to one another. Thus, the wrapping section 6 forms a double filter cigarette DFC which is equivalent to two filter cigarettes. In FIG. 2, an area $A_5$ corresponds to processes of feeding the paper piece PC to the wrapping section 6 and winding the paper piece PC, and the hatching in the paper piece PC represents a paste-backed surface.

The formed double filter cigarette DFC is delivered from the wrapping section 6 to a drum train 30. This drum train 30, like the aforementioned drum train 4, includes a plurality of grooved drums, and extends to the left-hand end of the main frame 2. The terminal of the drum train 30 is connected to a cigarette conveyor 32.

The double filter cigarette DFC fed to the drum train 30 is transported as each grooved drum in the drum train 30 rotates. One grooved drum 31 in the drum train 30 is provided with a rotary knife 34. As the double filter cigarette DFC passes the knife 34, the knife 34 cuts the double filter cigarette DFC in the center of its filter plug FP. As a result, the double filter cigarette DFC is divided into two filter cigarettes FC. As the filter cigarettes FC are then transported on the drum train 30, they are separated from each other in the axial direction thereof.

Thereafter, the filter cigarettes FC are delivered from the drum train 30 to the cigarette conveyor 32. After orienting the received filter cigarettes FC, the cigarette conveyor 32 transports these filter cigarettes toward a packaging machine (not shown).

In FIG. 2, a region $A_6$ corresponds to processes in which the two filter cigarettes FC are formed from the double filter cigarette DFC, and are separated from each other.

Filter Plug Feeding Apparatus

Figure 3:
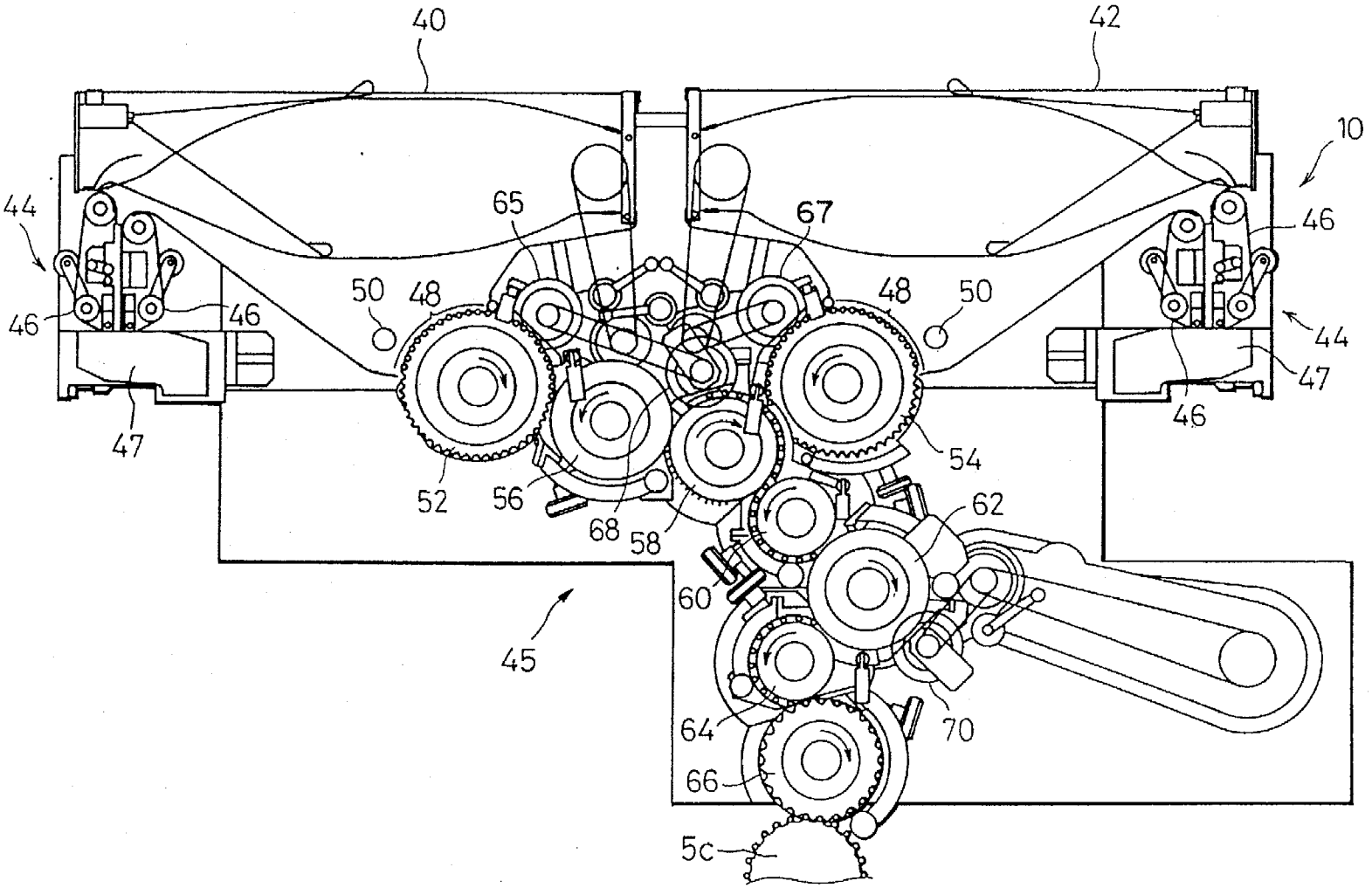
FIG. 3 is an enlarged view showing a filter plug feeding apparatus for the filter attachment of FIG. 1.

Referring to FIG. 3, there is shown in detail the aforementioned filter plug feeding apparatus 10. An outline of the feeding apparatus 10 will now be described in brief.

The feeding apparatus 10 is provided with a pair of hoppers 40 and 42. The hoppers 40 and 42 are located over the drum train 4, and are kept apart from each other in the horizontal direction. A pair of rod supply devices 44 are attached to the left-hand end portion of the hopper 40 and the right-hand end portion of the hopper 42, respectively.

Each supply device 44 includes a pair of belt conveyors 46. These conveyors 46 extend vertically so that a rod inlet passage is defined between them. The lower end of the rod inlet passage is connected to a reorientation device 47, while the upper end thereof opens into its corresponding hopper. The reorientation device 47 is connected to a filter rod manufacturing machine (not shown) by means of an air tube (not shown). This manufacturing machine can manufacture filter rods which are longer enough than the filter plugs, and deliver the manufactured filter rods into the air tube. The filter rods in the air tube, along with an air current, are transported to the reorientation device 47. The reorientation device 47 successively feed the filter rods transported thereto into the rod inlet passage between the pair of conveyor belts 46. As the belt conveyors 46 are driven, thereafter, the filter rods are fed into their corresponding hopper through the rod inlet passage. Then, the reorientation device 47 feeds the received filter rods into the rod inlet passage in a manner such that the respective axes of the filter rods extend at right angles to the rod inlet passage, whereupon the filter rods in the hopper are oriented in position.

Each of the hoppers 40 and 42 has a discharge port 48 at is lower part, and the front and rear edges of the port 48 are defined by the front and rear walls of the hopper, respectively. The front and rear walls 41 and 43 (see FIG. 6) of the hoppers 40 and 42 can move back and forth. Thus, the depth of each hopper and discharge port 48 can be adjusted in accordance with the length of the filter rods by moving the front and rear walls 41 and 43 back and forth. This adjustment prevents the center of the discharge port 48 of each hopper in the depth direction thereof from changing even though the size of the port 48 is changed.

An agitator roller 50 is located in the vicinity of the discharge port 48 of each hopper. The roller 50 serves smoothly to guide the filter rods in the hopper toward the discharge port 48 by rotating.

The discharge ports 48 of the hoppers 40*a* and 42 are connected to the drum train 4 by means of a drum train 45.

The drum train 45, like the drum trains 4 and 30, includes a plurality of grooved drums.

The discharge ports 48 of the hoppers 40 and 42 are closed by part of the outer peripheral surfaces of hopper drums 52 and 54 in the drum train 45, respectively. The hopper drums 52 and 54 are arranged in a manner such that the centers of their respective outer peripheral surfaces, with respect to the width direction, coincide with the center of corresponding discharge port 48.

A separation drum 56 is located adjacent to the hopper drum 52 on the side of the hopper 42, and an assembly drum 58 is provided between the separation drum 56 and the other hopper drum 54. The assembly drum 58 adjoins both of the drums 54 and 56.

A first grading drum 60 is located adjacent to the underside of the assembly drum 58, and a first aligning drum 62 adjoins the underside of the drum 60. Moreover, a second grading drum 64 is located adjacent to the underside of the first aligning drum 62, and a second aligning drum 66 is provided between the drum 64 and the grooved drum **5*c* in the drum train 4** so as to adjoin both these drums.

Basically, each of the above-described drums, ranging from the hopper drums 52 and 54 to the second aligning drum 66, is formed of a grooved drum. While the hopper drums 52 and 54 are rotating, therefore, their grooves can receive the filter rods in their corresponding hoppers as they pass the discharge ports 48 of the hoppers. Thereafter, the filter rods on the hopper drums, like the double cigarettes and single cigarettes transported by means of the drum trains 4 and 30, transfer in succession to the adjacent drums as they are fed toward the drum train 4. In FIG. 3, each drum is rotated in the direction of the arrow therein.

The hopper drums 52 and 54 are provided with rotary knives 65 and 66, respectively. The assembly drum 58 have a plurality of rotary knives 68, and the first aligning drum 62 also have a plurality of rotary knives 70. The numbers of the rotary knives 68 and 70 are settled depending on the type and length of the filter plugs to be formed. For example, the assembly drum 58 has two rotary knives 68, while the first aligning drum 62 has three rotary knives 70. In this case, those filter plugs which are fed to the drum train 4 by the apparatus 10 are dual filter plugs. The number of the rotary knives 70 is not limited to three, and may alternatively be six.

In order to form the dual filter plugs, the one hopper 40 is stored with charcoal filter rods, and the other hopper 42 with plain filter rods. The plain filter rods are formed of a filter material such as acetate fibers, pulp fibers, etc. The charcoal filter rods are obtained by charging plain filter rods with activated charcoal particles.

Figure 4:
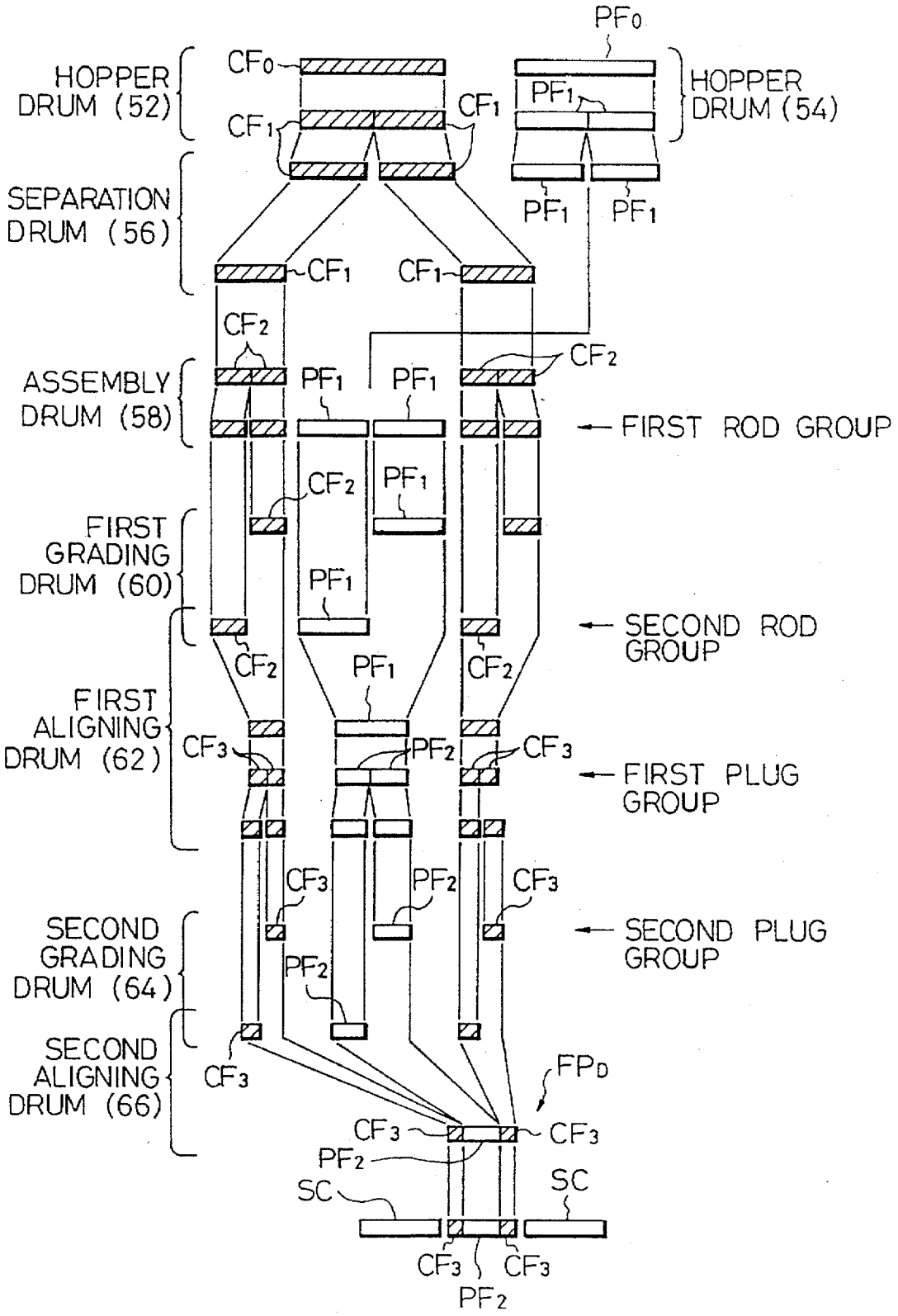
FIG. 4 is a diagram showing the flow of a dual filter plug forming process in the plug feeding apparatus of FIG. 3.

FIG. 4 shows a flow of processing for charcoal filter rods $CF_0$ and plain filter rods $PF_0$. In FIG. 4, charcoal filter rods $CF_0$ is hatched.

As a charcoal filter rod $CF_0$ discharged from the hopper 40 onto the hopper drum 52 passes the rotary knife 65, it is cut into two equal charcoal half rods $CF_1$ by the knife 65.

Thereafter, the two charcoal half rods $CF_1$, which are coaxial with each other, transfer from the hopper drum 52 to the separation drum 56. After the two charcoal half rods $CF_1$ on the separation drum 56 are separated axially from each other, they transfer to the assembly drum 58. Thus, a predetermined space is secured between the two charcoal half rods $CF_1$ on the assembly drum 58. Further, each charcoal half rod $CF_1$ on the assembly drum 58 is cut into two equal charcoal plugs $CF_2$ by one of the rotary knives 68.

As a plain filter rod $PF_0$ discharged from the hopper 42 onto the hopper drum 54 passes the rotary knife 67, on the other hand, it is cut into two equal plain half rods $PF_1$ by the knife 67. Thereafter, the two plain half rods $PF_1$ transfer from the hopper drum 54 to the assembly drum 58. The plain half rods $PF_1$ are situated between the two charcoal half rods $CF_1$, on the assembly drum 58. Thus, on the assembly drum 58, a first rod group is formed including the two charcoal half rods $CF_1$, separated right and left, and the two plain half rods $PF_1$, which are coaxially arranged side by side. At this time, as seen from FIG. 4, each charcoal half rod $CF_1$ is already cut into the two charcoal plugs $CF_2$.

When the components in the first rod group transfer from the assembly drum 58 to the first grading drum 60, thereafter, the two plain half rods $PF_1$ are separated in their feeding direction. The two pairs of charcoal plugs $CF_2$ are also separated in their feeding direction.

On the first grading drum 60, as seen from FIG. 4, the components in the first rod group are separated into two second rod groups in the feeding direction. Each second rod group includes one plain half rod $PF_1$ and a pair of charcoal plugs $CF_2$ which are situated individually on the opposite sides of the rod $PF_1$.

The components in each second rod group transfer from the first grading drum 60 to the first aligning drum 62. On the first aligning drum 62, the plain half rod $PF_1$ and the two charcoal plugs $CF_2$ are situated on predetermined feeding lines, respectively. When the components in the second rod group passes their corresponding rotary knives 70, thereafter, the plain half rod $PF_1$ is cut into two equal plain plugs $PF_2$, and each charcoal plug $CF_2$ is cut into two equal charcoal tips $CF_3$. Thus, a first plug group is formed on the first aligning drum 62. The first plug group includes two plain plugs $PF_2$ and two pairs of charcoal tips $CF_3$ situated individually on the opposite sides of the plugs $PF_2$.

If the first aligning drum 62 has six rotary knives 70, then each component in the second rod group will be cut into three equal parts. In this case, the first plug group includes three plain plugs $PF_2$ and two sets of three charcoal tips $CF_3$ situated individually on the opposite sides of the plugs $PF_2$.

When the elements in the first plug group transfer from the first aligning drum 62 to the second grading drum 64, thereafter, the first plug group, like the aforementioned first rod group, is divided into two or three second plug groups by the agency of the drum 64. Each second plug group includes one plain plug $PF_2$ and a pair of charcoal tips $CF_3$ which are situated individually on the opposite sides of the plug $PF_2$.

When the elements in each second plug group transfer from the second grading drum 64 to the second aligning drum 66, one charcoal tip $CF_3$ is adhered to each end of each plain plug $PF_2$, whereupon a dual filter plug $FP_D$ is obtained. In this state, the filter plug $FP_D$ is centered axially on the second aligning drum 66.

Thereafter, the filter plug $FP_D$ is fed from the second aligning drum 66 to the grooved drum **5*c* in the drum train 4, and is situated between a pair of single cigarettes SC on the drum 5*c*. The feed of the filter plug $PF_D$ is represented by the region $A_3$ in FIG. 2**.

The above-described feeding apparatus 10 is applicable to the feed of non-dual filter plugs as well as dual filter plugs $FP_D$. The non-dual filter plugs include plain filter plugs, triple filter plugs, recessed filter plugs, etc.

In the case where the feeding apparatus 10 feeds non-dual filter plugs to the drum train 4, both of its hoppers 40 and 42 are stored with filter rods of the same type and length. In the description to follow, the feeding apparatus 10 is supposed to feed plain filter plugs. In this case, the hoppers 40 and 42 are stored with plain filter rods $DP'_O$ and $DP_O$, respectively, which have a length equal to ⅔ of that of the plain filter rods $PF_O$.

Figure 5:
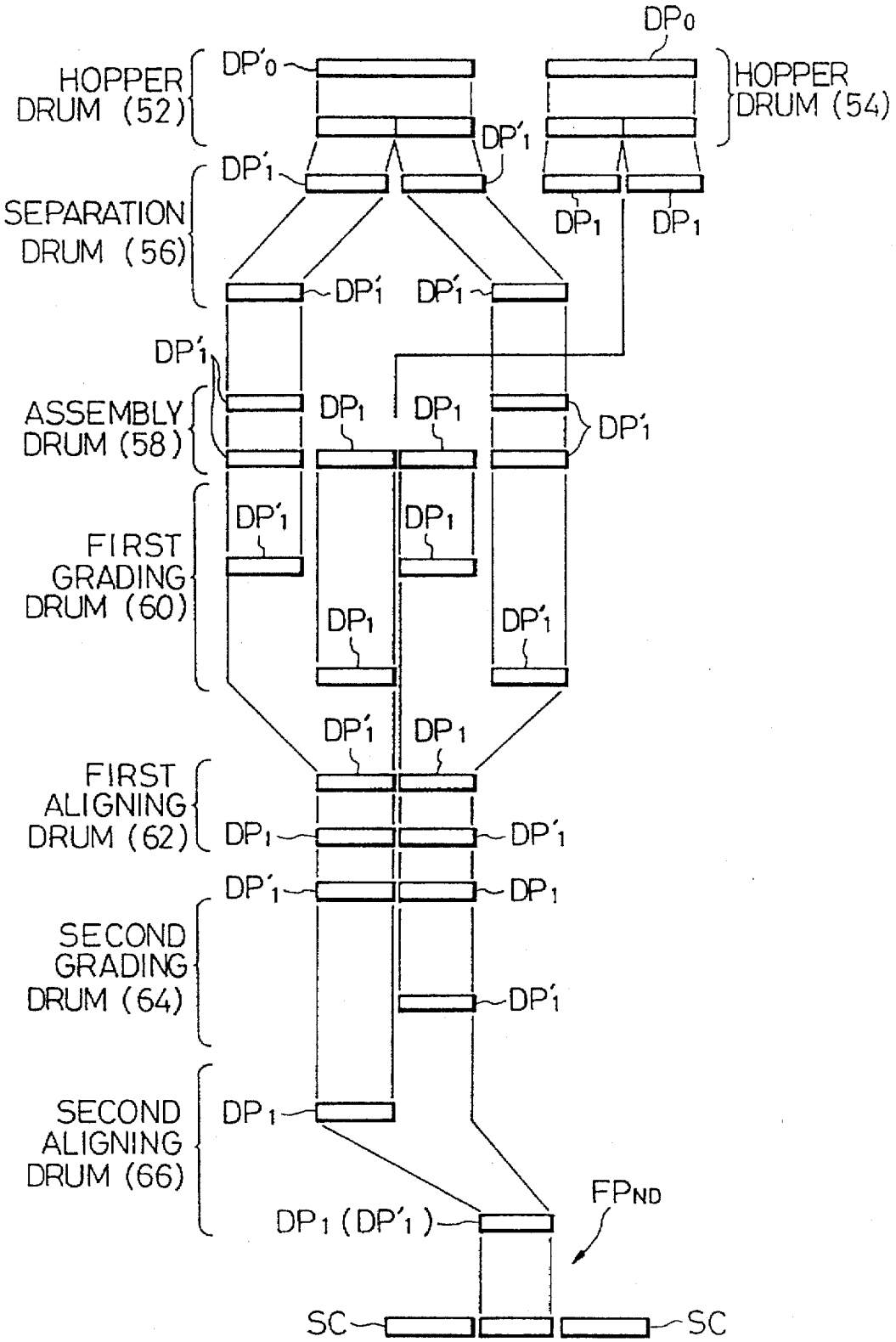
FIG. 5 is a diagram showing the flow of a non-dual filter plug forming process in the filter plug feeding apparatus of FIG. 3.

Referring to FIG. 5, there is shown a flow of processing for the plain filter rods $DP'_O$ and $DP_O$ delivered from the hoppers 40 and 42.

Each plain filter rod $DP'_O$ delivered from the hopper 40 onto the hopper drum 52 is cut into two equal plain filter plugs $DP'_1$ by the rotary knife 65, and the plugs $DP'_1$ transfer from the hopper drum 52 to the separation drum 56. The plain filter plugs $DP'_1$ on the separation drum 56 transfer to the assembly drum 58 after they are separated from each other in the axial direction. On the other hand, each plain filter rod $DP_O$ delivered from the hopper 42 to the hopper drum 54 is cut into two equal plain filter plugs $DP_1$ by the rotary knife 66, and the plugs $DP_1$ transfer from the hopper drum 54 to the assembly drum 58. On the assembly drum 58, the plugs $DP_1$ are situated between the two plain filter plugs $DP'_1$. Each plain plug $DP'_1$ on the assembly drum 58 will not be cut further. Thus, on the assembly drum 58, a third plug group is formed including the four plain plugs.

When the components in the third plug group transfer from the assembly drum 58 to the first grading drum 60, the third plug group is divided into two fourth plug groups in the feeding direction. As shown in FIG. 5, each fourth plug group includes the plain filter plugs $DP_1$ and $DP'_1$.

When the elements in each fourth plug group transfer from the first grading drum 60 to the first aligning drum 62, the plain plugs $DP_1$ and $DP'_1$ in the group are only centered axially without being cut further. When the elements in the fourth plug group transfer from the first aligning drum 62 to the second grading drum 64, thereafter, the plain plugs $DP_1$ and $DP'_1$ in the fourth plug group are separated in their feeding direction.

The plain plugs on the second grading drum 64 transfer in succession to the second aligning drum 66, and are centered axially on the drum 66, whereupon a non-dual filter plug $FP_{ND}$ is obtained. Thereafter, the filter plug $FP_{ND}$ is fed from the second aligning drum 66 to the grooved drum 5c in the drum train 4, and is situated between a pair of single cigarettes SC.

On the first aligning drum 62, each of the plain filter plugs $DP'_1$ and $DP_1$ will not be cut further. In the case where the plain filter rods fed from the hoppers 40 and 42, that is, the plain filter plugs $DP'_1$ and $DP_1$, are relatively long, each of them may be cut into a plurality of parts by means of the rotary knives 70.

The above is a description of an outline of the feeding apparatus 10. The individual drums and their peripheral arrangements will now be described successively in detail. To avoid repeated description, like reference numerals are used to designate like members and regions with the same functions throughout the several views.

Hopper Drums

Figure 6:
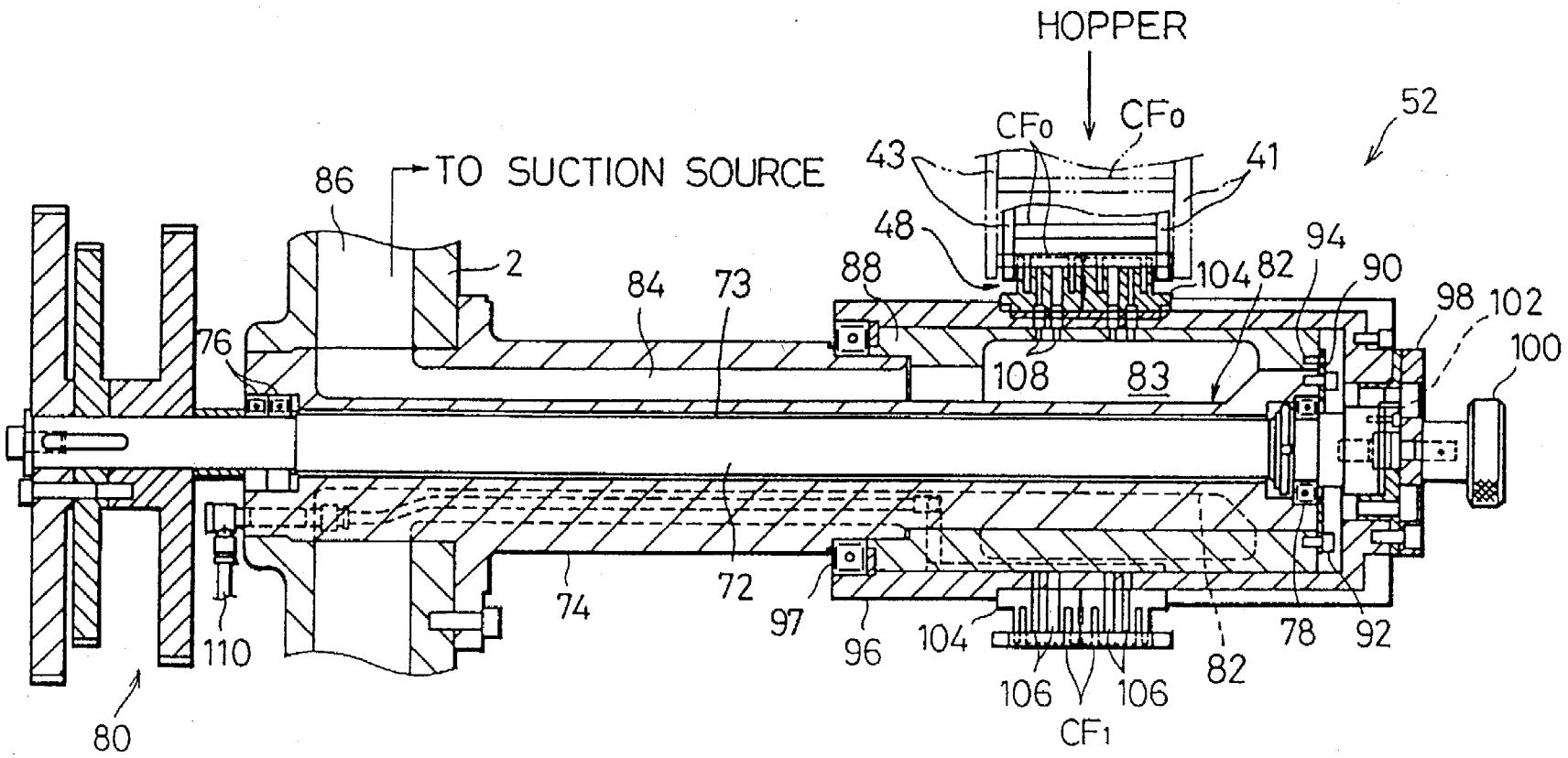
FIG. 6 is a longitudinal sectional view showing a hopper drum of FIG. 3.

Referring to FIG. 6, there is shown an example of the hopper drums 52 and 54. Since these hopper drums 52 and 54 have substantially the same construction, only the one hopper drum 52 will be described in the following.

The hopper drum 52 has a drum shaft 72 in the center. The drum shaft 72 is surrounded by a fixed sleeve 74, and an annular gap 73 is secured between the shaft 72 and the sleeve 74. The drum shaft 72 is rotatably supported on the fixed sleeve 74 by means of a pair of bearings 76 and 78. The fixed sleeve 74 is supported by the main frame 2 in a manner such that its proximal end portion is inserted in the frame 2.

The drum shaft 72 projects from the proximal end of the fixed sleeve 74 into the interior of the main frame 2, and its projecting end portion is fitted with a plurality of gears. These gears constitute part of a power transmission system 80. When power is transmitted from the transmission system 80 to the drum shaft 72, the shaft 72 is rotated in one direction.

The fixed sleeve 74 perpendicularly extends with respect to the main frame 2, and a plurality of openings 82 are formed in the outer peripheral surface of the distal end portion of the sleeve 74. These openings 82 are arranged at intervals in the circumferential direction of the fixed sleeve 74.

A plurality of axial passages 84 are formed in the fixed sleeve 74. The opposite ends of each passage 84 are connected to each opening 82 and a suction passage 86 in the main frame 2, individually. The suction passage 86 is connected to a suction source which includes a blower (not shown). Thus, a constant suction pressure is continually supplied from the suction source to the openings 82 through the suction passage 86 and the axial passages 84.

The openings 82 of the fixed sleeve 74 are externally covered airtight by a control sleeve 88. The control sleeve 88 is fixed to the distal end of the fixed sleeve 74 by means of a connecting disk 90, at least one connecting bolt 92, and a positioning pin 94. The positioning pin 94 settles the rotational phase of the control sleeve 88 with respect to the fixed sleeve 74. In the case where the sleeves 74 and 88 are formed with their respective marks instead of using the positioning pin 94, the rotational phase of the control sleeve 88 compared with the fixed sleeve 74 can be settled by aligning the marks.

The inner peripheral surface of the control sleeve 88 is formed with a groove, which forms a suction chamber 83 in conjunction with the openings 82 of the fixed sleeve 74. The suction chamber 83 extends throughout a predetermined region in the circumferential direction of the hopper drum 52.

A drum shell 96 is mounted airtight on the outer peripheral surface of the control sleeve 88 so as to be slidable thereon. One end of the drum shell 96 is rotatably supported on the outer peripheral surface of the control sleeve 88 by means of a bearing 97. The other end of the shell 96 extends beyond the control sleeve 88, and is connected to the distal end of the drum shaft 72.

The distal end of the drum shaft 72 projects from the fixed sleeve 74, and is releasably connected to the other end of the drum shell 96. A disk 98, knob 100, positioning key 102, and at least one connecting screws are used to connect the drum shaft 72 and the drum shell 96. Thus, the shell 96 can rotate integrally with the shaft 72.

If the knob 100 is loosed to be separated from the drum shaft 72 after the connecting screw is removed, the drum shell 96, along with the knob 100 and the disk 98, can be easily disengaged from the control sleeve 88. The positioning key 102 settles the rotational phase of the drum shell 96 with respect to the control sleeve 88.

A cylindrical grooved ring 104 is fixed on the outer peripheral surface of the drum shell 96. The outer peripheral surface of the ring 104 is formed with a large number of feeding grooves, which are arranged at regular intervals in the circumferential direction of the ring 104. When the drum shell 96 or the hopper drum 52 is rotated, the filter rods (e.g., charcoal filter rods $CF_O$) in the hopper 40 are received individually by the feeding grooves of the ring 104.

One end of each of a plurality of suction holes 106 opens in the base of each corresponding feeding groove of the grooved ring 104. These suction holes 106 extend radially penetrating the ring 104 and the drum shell 96, and the other end of each hole 106 opens in the inner peripheral surface of the shell 96.

The control sleeve 88 is formed with a plurality of suction slots 108, which can e connected individually to the suction holes 106 in the feeding grooves. More specifically, the suction slots 108 extend in the circumferential direction of the control sleeve 88, from a region in which the hopper drum 52 faces the discharge port 48 of the hopper 40 to a region just short of the circumscription point between the drum 52 and the separation drum 56. The slots 108 are connected to the suction chamber 83 at all times.

Further, the outer peripheral surface of the control sleeve 88 is formed with an atmosphere groove (not shown). The atmosphere groove is situated in a position corresponding to the aforesaid circumscription point between the hopper drum 52 and the separation drum 56, and extends in the axial direction of the control sleeve 88. The atmosphere groove communicates with the atmosphere at all times.

When the individual feeding grooves of the grooved ring 104 pass the discharge port 48 of the hopper 40 as the drum shell 96 rotates, they are connected to the suction chamber 83 through the suction holes 106 and the suction slots 108 of the control sleeve 88, and a suction pressure from the chamber 83 is supplied to the feeding grooves. This suction pressure serves to suck the charcoal filter rods $CF_0$ from the discharge port 48 of the hopper 40 into the feeding grooves, and the rods $CF_0$ are received by the feeding grooves. This suction of the charcoal filter rods $CF_0$ into the feeding grooves is continued until the grooves reach the region just short of the aforesaid circumscription point between the hopper drum 52 and separation drum 56. As the hopper drum 52 rotates, therefore, the feeding grooves of the grooved ring 104 take out the charcoal filter rods $CF_0$ one by one from the hopper 40, and feed the delivered rods $CF_0$ toward the separation drum 56.

Since the hopper drum 54 has the same construction as the hopper drum 52 described above, it can take out the filter rods from the hopper 42 and feed them toward the assembly drum 58.

The size of filter rods stored in the hoppers 40 and 42 varies depending on the type (dual or non-dual) of filter plugs to be fed to the drum train 4 by the feeding apparatus 10 and the brand of filter cigarettes to be manufactured by means of the filter attachment.

However, the front and rear walls 41 and 43 of the hoppers 40 and 42 can move back and forth, as mentioned before. When the filter rods are taken out from the discharge port 48 of each hopper onto the hopper drum, therefore, the axial center of each filter rod is located accurately on the feeding line of the hopper drum, or in the axial center of the grooved ring 104 thereof. Thus, the filter rods delivered to the hopper drum can be accurately transported on the feeding line of the drum, despite their differences in length. In FIG. 6, discharge ports 48 whose lengths with respect to the depth direction of hopper vary depending on the length of the filter rods are indicated by full lines and two-dot chain lines, respectively. The respective centers of these ports 48 are in alignment with the feeding line of the hopper drum or the axial center of the grooved ring 104.

Blow pipes 110 are disposed individually in the passages 84 of the fixed sleeve 74. The pipes 110 extend through the passages 84 to the suction chambers 82, and one end of each pipe 110 is connected to a jet groove in the outer peripheral surface of the control sleeve 88. The jet groove extends in the axial direction of the sleeve 88, and is situated at circumferential distances from the suction slots 108 of the sleeve 88. The other end of the blow pipe 110 extends outside the fixed sleeve 74, and is connected to a pneumatic pressure source (not shown). When the feeding grooves of the grooved ring 104 are cyclically connected to the jet grooves through the suction holes 106 while the drum shell 96 is rotating, compressed air is jetted from the jet grooves into the feeding grooves, thereby removing dust from the feeding grooves.

Figure 7:
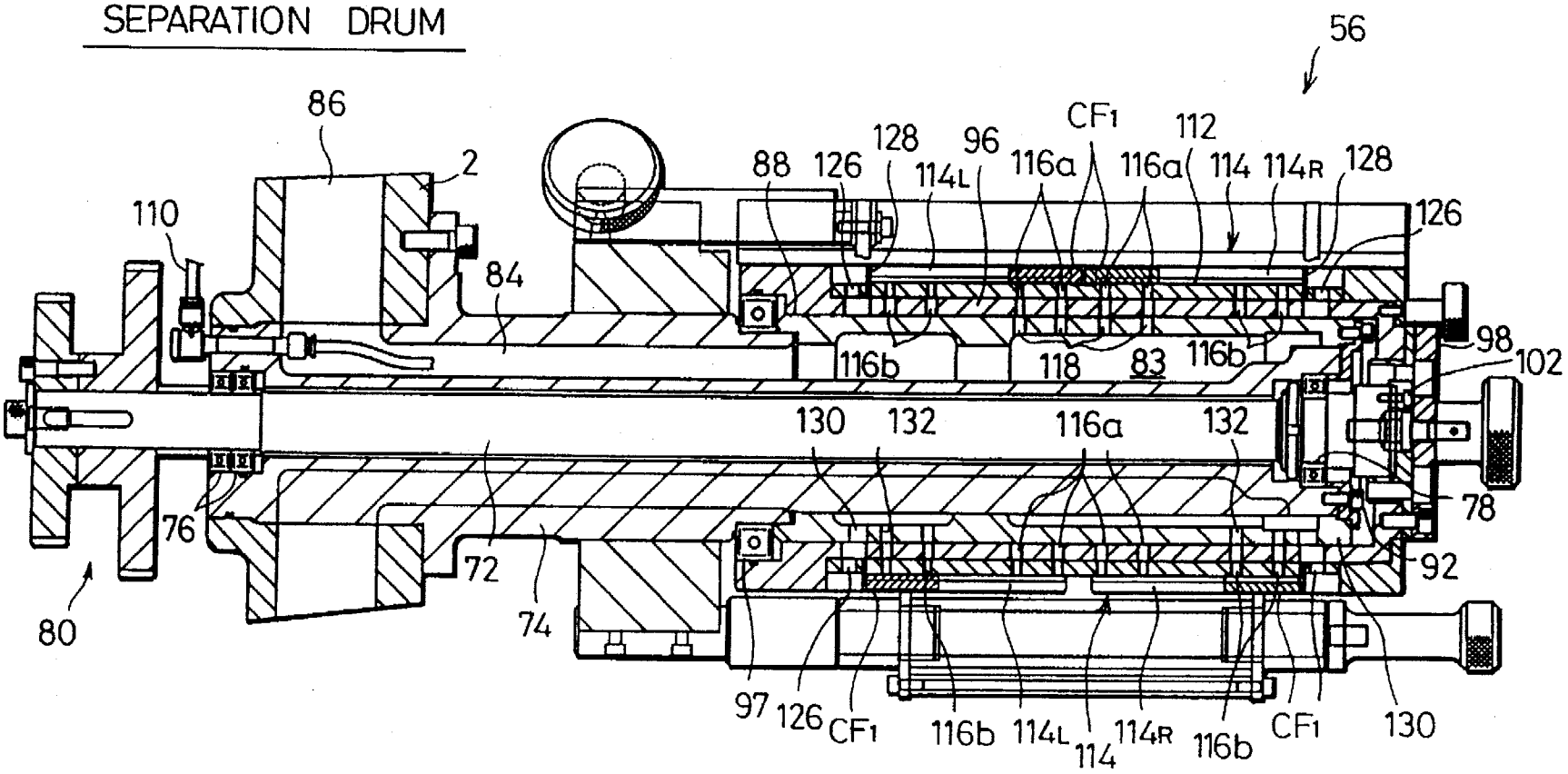
FIG. 7 is a longitudinal sectional view showing a separation drum of FIG. 3.

Separation Drum FIG. 7 shows a profile of the separation drum 56, whose construction is similar to that of each hopper drum described above. In the case of the separation drum 56, a suction chamber 83 between a fixed sleeve 74 and a control sleeve 88 is formed covering the whole circumference of the fixed sleeve 74.

The separation drum 56 also has a drum shell 96, and a cylindrical grooved ring 112 is mounted on the outer peripheral surface of the shell 96. The ring 112 is longer than the grooved ring 104 of the aforesaid hopper drum with respect to the axial direction. However, the respective axial centers of the rings 104 and 112 are in line with each other. Thus, the respective feeding lines of the hopper drum 52 and the separation drum 56 are aligned with each other.

The grooved ring 112 is also formed with a large number of feeding grooves 114. The grooves 114 are arranged at regular intervals in the circumferential direction of the ring 112, and extend throughout the length of the ring 112. The pitches between the feeding grooves 114 are equal to those between the feeding grooves of the hopper drum 52.

Further, each feeding groove 114 has a depth such that a filter rod received thereby can be hidden entire therein, and its inner surface is smoothed. Accordingly, the filter rod in each groove 114 can easily slide in its axial direction. On the both side of each feeding groove 114 are formed a pair of leads **114*a* which extend along the feeding groove 114. These leads 114*a* communicate with the feeding groove 114**.

Let it be supposed that each feeding groove 114 is divided in two, left- and right-hand groove portions $114_L$ and $114_R$, from its center thereof in the axial direction as shown in FIG. 7. Therefore, the groove portions $114_L$ and $114_R$ has one end region adjacent to each other. Thereupon, a pair of suction holes **116*a* are formed in the base of one end region of each of the groove portions $114_L$ and $114_R$, and another pair of suction holes 116*b* in the other end region. These suction holes 116 radially penetrate the drum shell 96 and open in the inner peripheral surface of the shell 96**.

Figure 8:
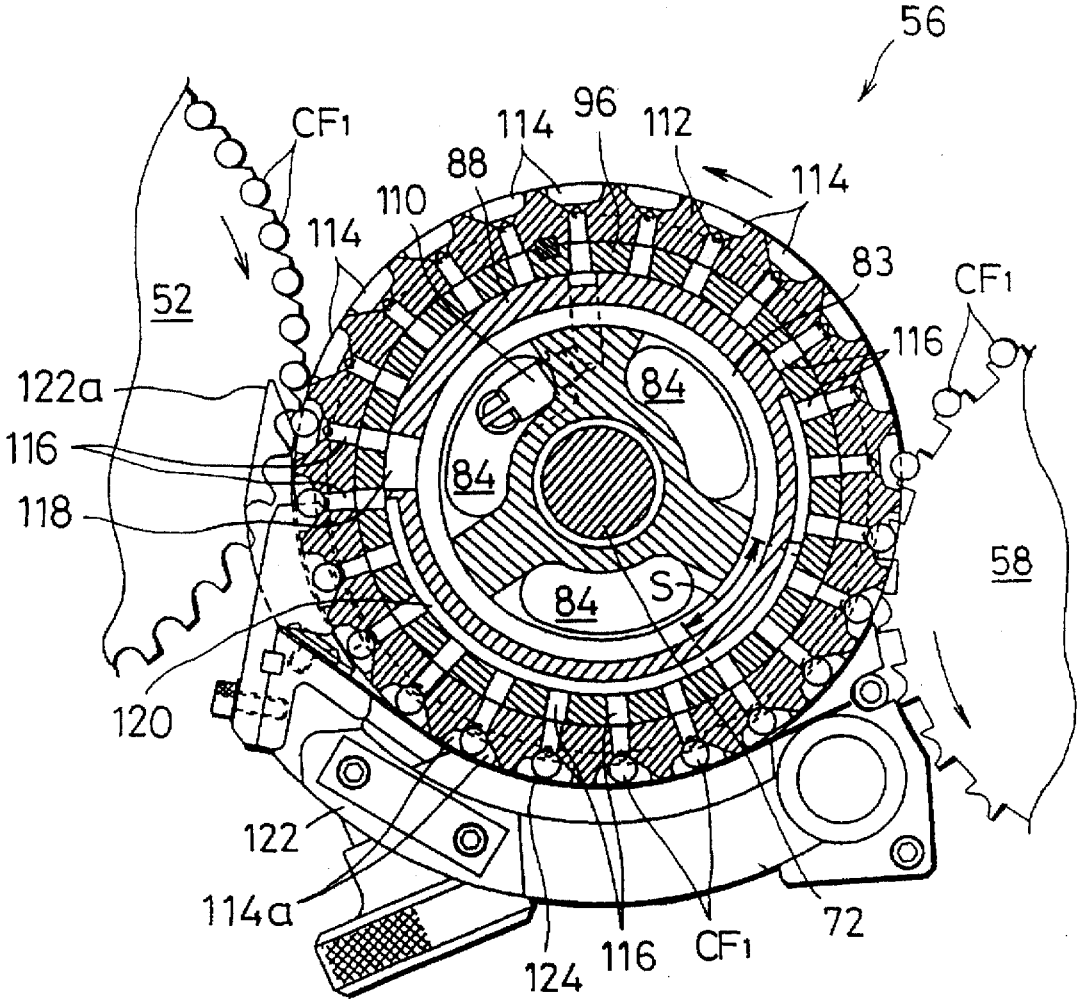
FIG. 8 is a cross-sectional view of the separation drum of FIG. 7.

The control sleeve 88 of the separation drum 56 is formed with four suction slots 118, which are situated in the central region of the sleeve 88 in the axial direction thereof. More specifically, the suction slots 118 can be connected individually to their corresponding ones of the four suction holes **116*a* which are situated at the right-hand end portion of the groove portion $114_L$ and the left-hand end portion of the groove portion $114_R$. As shown in FIG. 8, moreover, the suction slots 118 extend in the circumferential direction of the control sleeve 88 for a predetermined length from the circumscription point between the drum 56 and the hopper drum 52, with respect to the rotating direction of the separation drum 56**.

When a pair of charcoal half rods $CF_1$ (which are obtained by cutting a charcoal filter rod $CF_0$ into two equal parts on the hopper drum 52) reach the circumscription point between the drum 52 and the separation drum 56, they transfer from the drum 52 to the drum 56. More specifically, when the pair of charcoal half rods $CF_1$ are released from suction on the side of the hopper drum 52 as one of the feeding grooves 114 of the separation drum 56 passes by the hopper drum 52, this groove 114 is connected to the suction slots 118 by means of the suction holes 116*a*. At this time, the charcoal half rods $CF_1$ on the separation drum 56 are received separately by the left- and right-hand groove portions $114_L$ and $114_R$ of the feeding groove 114, as shown in FIG. 7.

When the rotation of the separation drum 56 or the drum shell 96 is advanced, thereafter, the feeding groove 114, having received the pair of charcoal half rods $CF_1$, passes the suction slots 118, whereupon the half rods $CF_1$ are released from suction.

Further, the outer peripheral surface of the control sleeve 88 is formed with four atmosphere grooves 120 (see FIG. 8). Each atmosphere groove 120 is situated on the circumference of the same circle as its corresponding suction slot 118, and extends a point near the suction slot 118 beyond the circumscription point between the separation drum 56 and the assembly drum 58, in the rotating direction of the drum 56. The atmosphere grooves 120 open into the atmosphere at the end face of the separation drum 56, and atmospheric pressure is continually supplied to the grooves 120. Thus, when the feeding grooves 114 are connected to the atmosphere grooves 120 through the suction holes 116*a*, individually, the atmosphere is introduced into the grooves 114.

Since each atmosphere groove 120 is formed covering the lower semicircular region of the separation drum 56, the introduction of the atmosphere into each transportation groove 114 prevents the pair of charcoal half rods $CF_1$ from being kept in the groove 114 by suction. Accordingly, the lower semicircular region of the separation drum 56 is externally surrounded by a cowl 122.

In order to ensure the transfer of the charcoal half rods $CF_1$ between the hopper drum 52 and the separation drum 56, a plurality of forked claws 122*a* are attached to the distal end portion of the cowl 122 on the side of the hopper drum 52. As is generally known, these claws 122*a* penetrate the hopper drum 52 without hindering the rotation of the drum 52.

Figure 9:
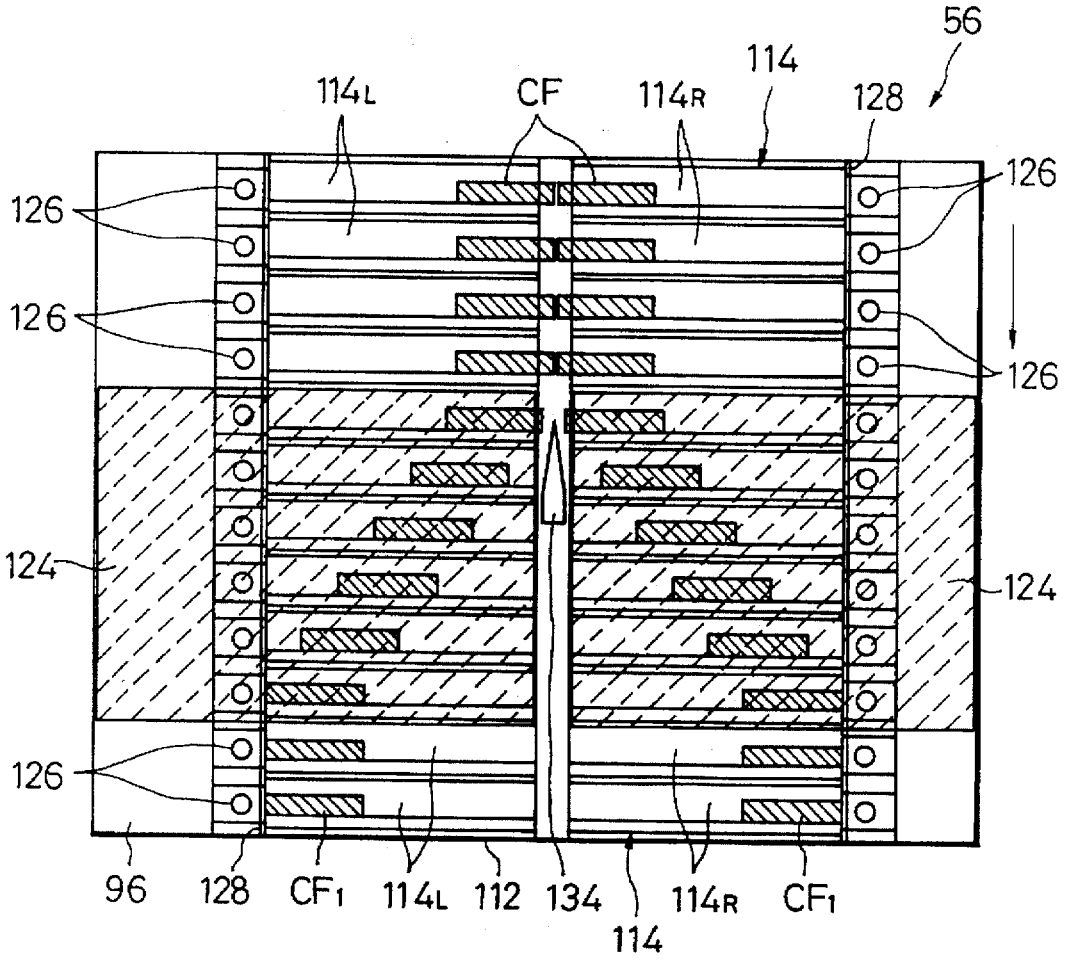
FIG. 9 is a development showing the outer peripheral surface of the separation drum of FIG. 7.

Two sealing sheets 124 are arranged between the cowl 122 and the separation drum 56 as shown in FIG. 8. More specifically, the sheets 124 are situated left and right with respect to the axial direction of the separation drum 56 as shown in FIG. 9, and are fixed separately to the cowl 122. In FIG. 9, the sealing sheets 124 are hatched by broken lines. Each sealing sheet 124 extends close to the assembly drum 58 from the side of the hopper drum 52, and covers the outer peripheral surface of the separation drum 56 or its grooved ring 112. A seal member (not shown) is located between the outer side edge of each sealing ring 124 and each end of the drum shell 96. When the feeding grooves 114 passes under the sealing sheets 124 as the separation drum 56 rotates, therefore, they form tunnel-shaped passages.

As shown in FIG. 9, suction ports 126 open in the base of each feeding groove 114 at the opposite end portions thereof, individually. These ports 126 radially penetrate the drum shell 96 and open in the inner peripheral surface of the shell 96.

Further, a stopper ring 128 is attached to each end portion of the grooved ring 112. The rings 128 divide the interior of each feeding groove 114 into end regions including the suction ports 126 and a central region. The stopper rings 128 are formed with a large number of notches which allow the end regions and central region of each feeding groove 114 to communicate with one another at all times. Instead of using the stopper rings 128, semicircular stopper pieces may be arranged in each feeding groove 114. Also in this case, however, each stopper pieces must be formed with holes or notches by means of which the end regions and central regions of the transportation groove 114 communicate with one another.

As shown in FIG. 7, suction slots 130 are formed individually in the opposite end portions of the outer peripheral surface of the control sleeve 88. These slots 130 are situated in positions where they can be connected individually to the suction ports 126. The suction slots 130 are connected to the suction chamber 83 at all times. Moreover, the slots 130 extend in the circumferential direction from the side of the hopper drum 52 toward the assembly drum 58, with respect to the rotating direction of the separation drum 56. The range of formation of the suction slots 130 is set within the area for the formation of the atmosphere grooves 120, that is, the area in which the feeding grooves 114 of the grooved ring 112 are covered by the sealing sheets 124.

Each end portion of the control sleeve 88 is further formed is a pair of suction slots 132 which are situated close to each corresponding suction slot 130. Each suction slot 132 is situated in a position where it can be connected to its corresponding suction holes 116*b*. The suction slots 132 are also connected to the suction chamber 83 at all times. Each suction slot 132 extends from a point just ahead of the terminal of each corresponding suction slot 130 to a point just short of the circumscription point between the separation drum 56 and the assembly drum 58, with respect to the rotating direction of the separation drum 56. In FIG. 8, the area for the suction slots 132 is designated by symbol S.

If necessary, moreover, a wedge-shaped separation guide 134 is attached to the inner surface of the cowl 122 as shown in FIG. 9. The separation guide 134 is situated in a position where the suction ports 126 start to be supplied with a suction pressure, between the left- and right-hand sealing sheets 124. A pointed end of the guide 134 is directed to the hopper drum 52.

As the separation drum 56 rotates, the pair of charcoal half rods $CF_1$ received from the hopper drum 52 by the left- and right-hand groove portions $114_L$ and $114_R$ of each feeding groove 114 of the drum 56 are fed toward the assembly drum 58.

When the separation drum 56 further rotates so that the pair of charcoal half rods $CF_1$, along with the feeding groove 114, enter the area of the sealing sheets 124, the suction ports 126 of the groove 114 are connected individually to the suction slots 130 of the control sleeve 88. At this time, the left- and right-hand groove portions $114_L$ and $114_R$ of the groove 114 which holds the pair of charcoal half rods $CF_1$ therein form tunnel-shaped passages in conjunction with the pair of sealing sheets 124, so that the rods $CF_1$ are moved toward their corresponding suction ports 126 under the suction pressure from the ports 126, as shown in FIG. 9. Thereupon, these rods $CF_1$ move so as to abut individually against the stopper rings 128 and then stop there. Thus, the charcoal half rods $CF_1$ are separated left and right for a predetermined distance from each other.

When the charcoal half rods $CF_1$, along with the feeding groove 114, enter the area of the sealing sheets 124, the suction holes 116*a* of groove 114 are connected to the atmosphere grooves 120 of the control sleeve 88, so that the rods $CF_1$ are released from suction. Thus, the pair of charcoal half rods $CF_1$ in the feeding groove 114 can be easily separated left and right by suction pressure from the suction ports 126. Even though the suction from the suction holes 116*a* is not applied to the charcoal half rods $CF_1$, they are held by the forked claws 122*a* of the cowl 122 and can never slip out of the feeding groove 114.

When the air in the feeding groove 114 is sucked, the currents of air are generated in the paired leads 114*a* of the feeding groove 114. The air currents help the charcoal half rods $CF_1$ move in the feeding groove 114, and at the same time guide the charcoal half rods $CF_1$. Therefore, the charcoal half rods $CF_1$ move without rising in the feeding groove 114.

Additionally, when the pair of charcoal half rods $CF_1$ pass the separation guide 134, even if the rods $CF_1$ are contacted with the separation guide 134, the suction pressure is already applied to each of the rods $CF_1$. Thus, the contact force applied to the charcoal half rods $CF_1$ is small, so that they can be prevented from being damaged by the guide 134.

Figure 10:
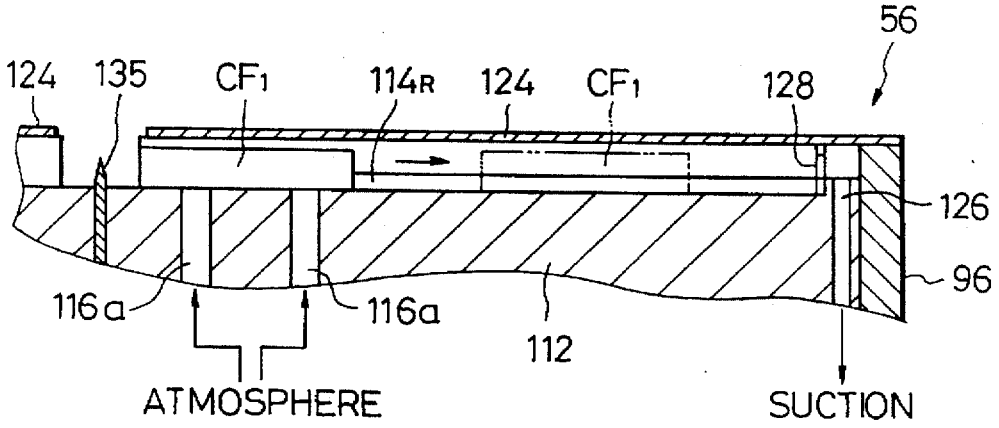
FIG. 10 is an enlarged view showing part of the separation drum of FIG. 7.

Alternatively, the separation guide 134 may be replaced by a ring blade 135 as shown in FIG. 10. The separating ring 135 is situated in the center of the grooved ring 112 with respect to the axial direction of the ring 112. The ring blade 135 has a thickness thinner than a gap between the pair of charcoal half rods $CF_1$. The gap is obtained by cutting the charcoal filter rod $CF_0$. In this case, when the pair of charcoal half rods $CF_1$ received from the hopper drum 52 by the left- and right-hand groove portions $114_L$ and $114_R$, the peripheral edge of the ring blade 135 is inserted into the gap between the rods $CF_1$.

Referring to FIG. 10, there is definitely shown the groove portion $114_R$ of the tunnel-shaped feeding groove 114. When the charcoal half rod $CF_1$ in the groove portion $114_R$ is sucked under the suction pressure from the suction ports 126, the atmospheric pressure is supplied to the pair of suction holes 116*a* of the groove 114, so that the rod $CF_1$ is released from the holding force. As a large quantity of air flows into the feeding groove 114 from between the left- and right-hand sealing sheets 124, moreover, the charcoal half rod $CF_1$ is securely moved toward its corresponding stopper ring 128, and stops abutting against the ring 128.

When the separated charcoal half rods $CF_1$, along with the feeding groove 114, get out from under the sealing sheets 124, thereafter, the suction holes 116*b* of the groove 114 are connected to the suction slots 132 of the control sleeve 88. Thus, each rod $CF_1$ is held in its corresponding groove portion by suction in a manner such that it abuts against its corresponding stopper ring 128. This suctional holding is continued until the feeding groove 114 reaches a point just short of the circumscription point between the separation drum 56 and the assembly drum 58.

The distance of separation between the pair of charcoal half rods $CF_1$ to be separated left and right on the separation drum 56 is set to be longer than the maximum length of filter rods which are fed from the hopper 42 to the assembly drum 58 via the hopper drum 54. Thus, the separation drum 56 can be used without regard to the type of filter plugs, duel or non-dual, which are fed by means of the feeding apparatus 10.

Inevitably, therefore, the necessary distance of separation between the pair of filter rods on the separation drum 56 is long. Since these half rods are moved in the feeding groove 114 by the suction pressure and the air currents produced in the paired lead 114*a* of the feeding groove 114, or the tunnel-shaped passage, they can move at high speed despite the long distance of separation between the half rods. Even though the peripheral speed of the separation drum 56 is increased with the development of higher-speed versions of filter attachments, therefore, the drum 56 can fulfill the aforesaid primary function thereof. Even when the half rods are sucked strongly on the separation drum 56, the sealing sheet 124 can securely prevent the half rods from jumping out of the feeding groove 114.

Assembly Drum

Figure 11:
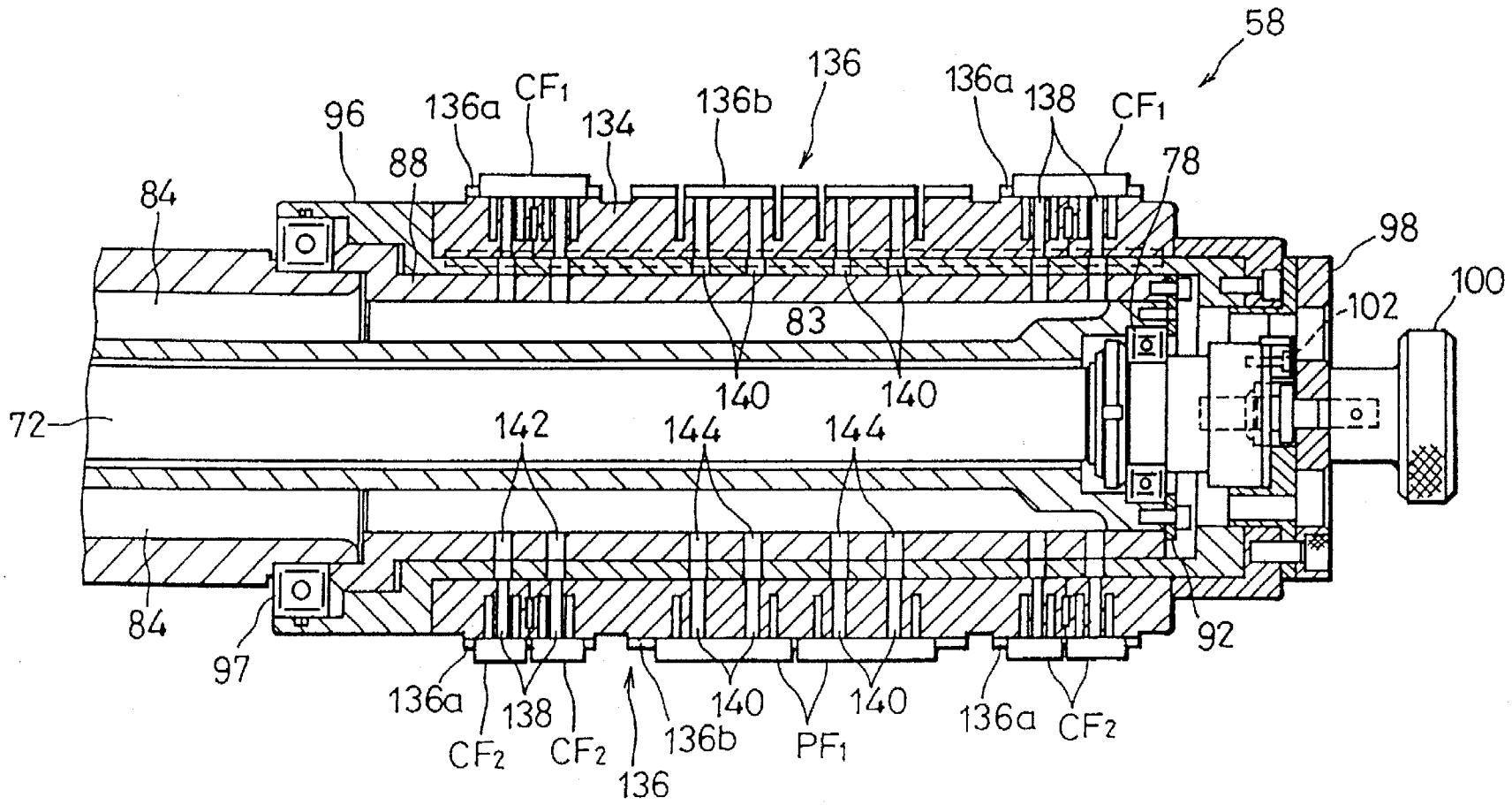
FIG. 11 is a longitudinal sectional view showing an assembly drum of FIG. 3.

FIG. 11 shows a profile of the assembly drum 58. A suction chamber 83 of the assembly drum 58, like that of the separation drum 56, is formed covering the whole inner peripheral area of a control sleeve 88.

A drum shell 96 of the assembly drum 58 is provided with a grooved ring 134 on the outer peripheral surface thereof. A large number of feeding grooves 136 are formed on the outer peripheral surface of the ring 134. The grooves 136 are arranged at regular intervals in the circumferential direction of the grooved ring 134. The pitches between the feeding grooves 136 are equal to those between the feeding grooves 114 of the separation drum 56. Each feeding groove 136 is divided into a pair of groove portions 136*a*, which are situated individually in the opposite end portions of the grooved ring 134, and a groove portion 136*b* in the central region of the ring 134. The distance between the pair of groove portions 136*a* is equal to the distance between the filter half rods $CF_1$ which are separated left and right on the separation drum 56.

A pair of suction holes 138 are formed in the base of each groove portion 136*a*. The suction holes 138 radially penetrate the drum shell 96 and open in the inner peripheral surface of the shell 96. On the other hand, four suction holes 140 are formed in the base of the groove portion 136*b*. The suction holes 140 also radially penetrate the drum shell 96 and open in the inner peripheral surface of the shell 96. Supposing the groove portion 136*b* is divided into two regions in its axial center, two of the suction holes 140 are distributed to each region, as seen from FIG. 11.

The control sleeve 88 of the assembly drum 58 is formed with a plurality of suction slots 142, which are situated so as to be connectable with their corresponding suction holes 138. Further, the control sleeve 88 is formed with a plurality of suction slots 144, which are situated so as to be connectable with their corresponding suction holes 140. Each of suction slot 142 and 144 extends from the circumscription point between the separation drum 56 and the assembly drum 58 to a point just short of the circumscription point between the assembly drum 58 and the first grading drum 60, in the circumferential direction of the control sleeve 88.

Thus, the pair of charcoal half rods $CF_1$ fed on the separation drum 56 transfer to the assembly drum 58. Thereupon, the rods $CF_1$ are attracted to and received by the pair of groove portions 136*a* of one of the feeding grooves 136 of the assembly drum 58. As the assembly drum 58 rotates, thereafter, the pair of charcoal half rods $CF_1$ are fed toward the hopper drum 54. In this process of feeding, the rods $CF_1$ are cut into equal parts by the pair of rotary knives 68 (see FIG. 3) of the assembly drum 58. Thus, two charcoal plugs $CF_2$ can be obtained from each charcoal half rod $CF_1$ on the assembly drum 58.

On the other hand, a plain filter plugs $PF_0$ delivered from the hopper 42 by the hopper drum 54 is divided into a pair of equal plain half rods $PF_1$ on the hopper drum 54, and are then fed toward the assembly drum 58. The plain half rods $PF_1$ on the hopper drum 54 transfer to the assembly drum 58, and are attracted to and received by the groove portion 136*b* of the feeding groove 136 of the drum 58. Thus, the pair of plain half rods $PF_1$ are received on each side of the pairs of charcoal plugs $CF_2$ by the groove 136 of the assembly drum 58, whereupon the aforesaid first rod group is formed. As the assembly drum 58 rotates, thereafter, the components in the first rod group are fed toward the first grading drum 60.

In the case where the filter half rods fed on the separation drum 56 are not charcoal half rods but ones for the formation of non-dual filter plugs, they need not be cut on the assembly drum 58 in the aforesaid manner. In this case, therefore, the rotary knives 68 of the assembly drum 58 are removed or separated from the peripheral surface of the drum 58.

Even in the case where the filter rods fed from the hopper 42 have different lengths, moreover, the assembly drum 58 can receive the filter rods in the groove portion 136*b* of each feeding groove 136 thereof. In this state, the longitudinal center of each filter rod is coincident with the axial center of the groove portion 136*b*.

Rotary Knives

Figure 12:
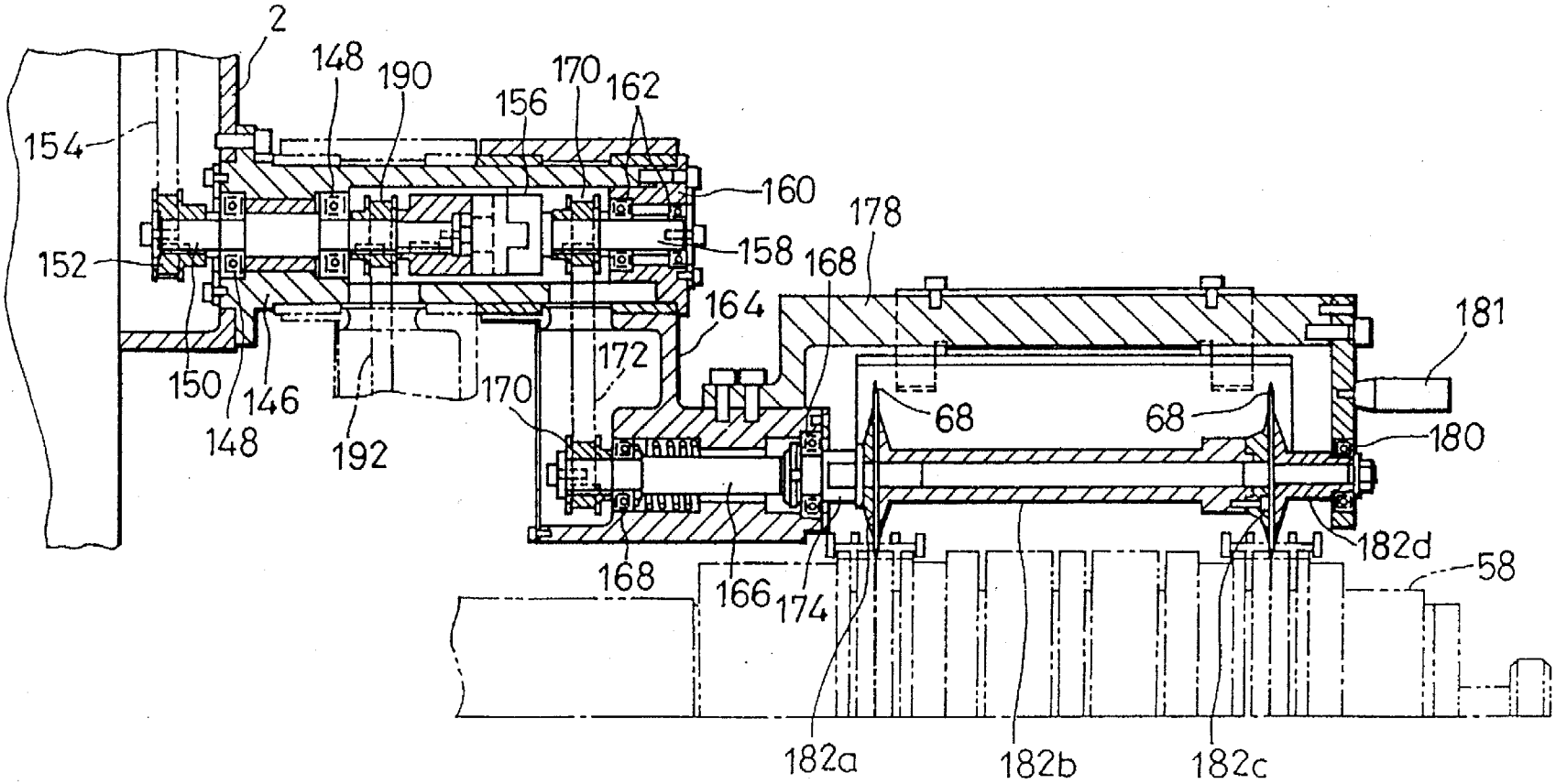
FIG. 12 is a view showing a supporting structure and a power transmission system for rotary knives attached to the assembly drum.

The following is a description of the arrangement of the rotary knives 68 and their surroundings. Referring to FIG. 12, there are shown a supporting structure for the rotary knives 68 and a power transmission system for the knives 68. As shown in FIG. 12, a bearing sleeve 146 projects from the main frame 2 toward the assembly drum 58. A drive shaft 150 is disposed in the bearing sleeve 146. It is rotatably supported in the sleeve 146 by means of a pair of bearings 148.

A toothed pulley 152 is mounted on one end of the drive shaft 150 which is situated on the side of the main frame 2. The pulley 152 is connected to a toothed pulley on the side of an electric motor by means of an endless toothed belt 154. A transmission shaft 158 is connected to the other end of the drive shaft 150 by means of an Oldham's coupling 156. The shaft 158 is rotatably supported on an end plate 160 of the bearing sleeve 146 by means of a pair of bearings 162. The end plate 160 closes an opening at the distal end of the sleeve 146.

The upper end of an arm 164 is rockably mounted on the distal end portion of the bearing sleeve 146. The arm 164 extends downward, and a knife holder 178 is mounted on its lower end portion. The holder 178 extends over the assembly drum 58 in the axial direction thereof, and has an end portion facing the lower end portion of the arm 164. A knob 181 is attached to the other end portion of the knife holder 178.

A knife shaft 166 is located penetrating the lower end portion of the arm 164. The shaft 166 overlies the assembly drum 58 so as to extends parallel to the axis thereof. One end portion of the knife shaft 166 is rotatably supported by the lower end portion of the arm 164 with the aid of a pair of bearings 168, while the other end of the shaft 166 is rotatably supported by the other end portion of the knife holder 178 with the aid of a bearing 180.

A pair of toothed pulleys 170 are mounted individually on the respective first ends of the transmission shaft 158 and the knife shaft 166, and an endless toothed belt 172 is passed around and between the pulleys 170.

The knife shaft 166 is fitted with the pair of rotary knives 68 with the aid of a distance collar 174 and holder collars 182*a*, 182*b*, 182*c* and 182*d*. The knives 68 are sandwiched between their corresponding holder collars, and are spaced at a predetermined distance from each other in the axial direction of the assembly drum 58. Thus, each rotary knife 68 is situated in a cutting position for each charcoal half rod $CF_1$ to be cut on the assembly drum 58.

When the rotation of the drive shaft 150 is transmitted to the knife shaft 166 through the aforementioned power transmission system, the pair of rotary knives 68 are rotated simultaneously, thereby cutting the pair of charcoal half rods $CF_1$ passing over the assembly drum 58.

If the rotary knives 68 need not be used, the arm 164 is rocked upward around the bearing sleeve 146, whereupon the knives 68 are separated upward from the assembly drum 58.

If the drive shaft 150 and the transmission shaft 158 are separated from the Oldham's coupling 156 in this state, the arm 164 is allowed to be disengaged from the bearing sleeve 146, and the pair of knives 68 can be removed together with the arm 164. In this case, the knife section which is situated on the right of line R—R in FIG. 12 is removed.

Figure 13:
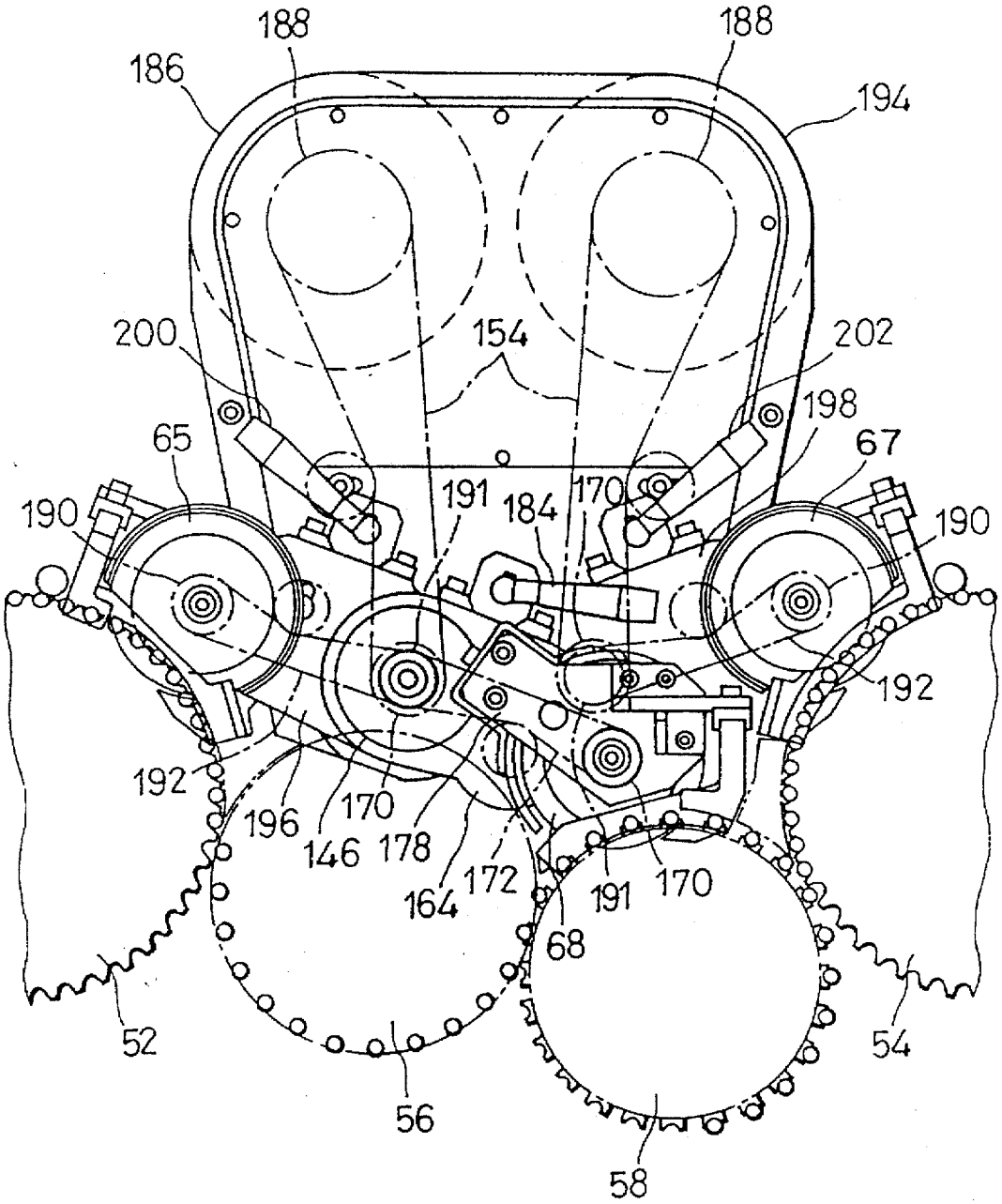
FIG. 13 is an enlarged view showing part of the plug feeding apparatus of FIG. 3.

Referring to FIG. 13, there are shown an electric motor 186 for the rotary knives 68 and a toothed pulley 188 mounted on the output shaft of the motor 186, as well as a handle 184 used to rock the arm 164.

FIG. 13 also shows power transmission systems for the rotary knives 65 and 67 of the hopper drums 52 and 54. The power transmission system for the rotary knife 65 includes toothed pulleys 190 on and 191. The pulley 190 is mounted on the knife shaft of the rotary knife 65 and the pulley 191 is mounted on the drive shaft 150. An endless toothed belt 192 is passed around and between the pulleys 190 and 191. Thus, the rotary knife 65 of the hopper drum 52, like the rotary knives 68 of the assembly drum 58, is rotated by means of power from the electric motor 186.

On the other hand, the power transmission system for the rotary knife 67 of the hopper drum 54 includes an independent electric motor 194. The output of the motor 194 is transmitted to the rotary knife 67 in the same manner as in the case of the rotary knife 65.

Moreover, the rotary knives 65 and 67 are rotatably supported on arms 196 and 198, respectively, which can rock upward around the axes of the toothed pulleys 191. The arms 196 and 198 can be rocked by means of handles 200 and 202.

Figure 14:
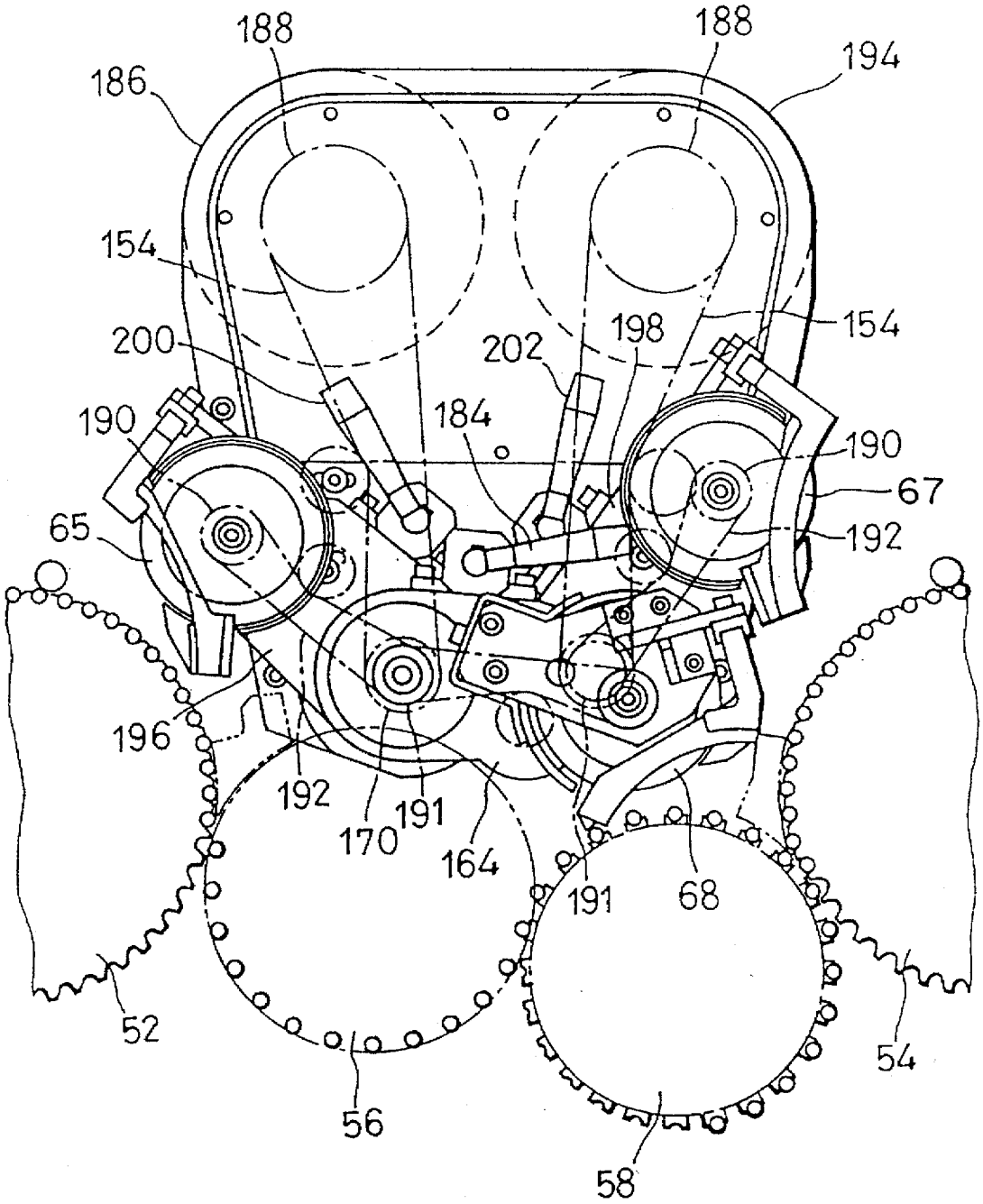
FIG. 14 is a view showing a state in which rotary knives of FIG. 13 are separated from their corresponding drums.

FIG. 14 shows the arms 164, 196 and 198 in a state after they are rocked upward. In this state, the rotary knives 65, 67 and 68 are separated upward from the hopper drums 52 and 54 and the assembly drum 58. If the arms for the individual rotary knives are allowed to rock in this manner, the knives can be replaced with ease.

The arrangement of the surroundings of the rotary knives 65, 67 and 68 shown in FIG. 3 is not exactly identical with the one shown in FIGS. 13 and 14 for ease of illustration only.

First Grading Drum

Figure 15:
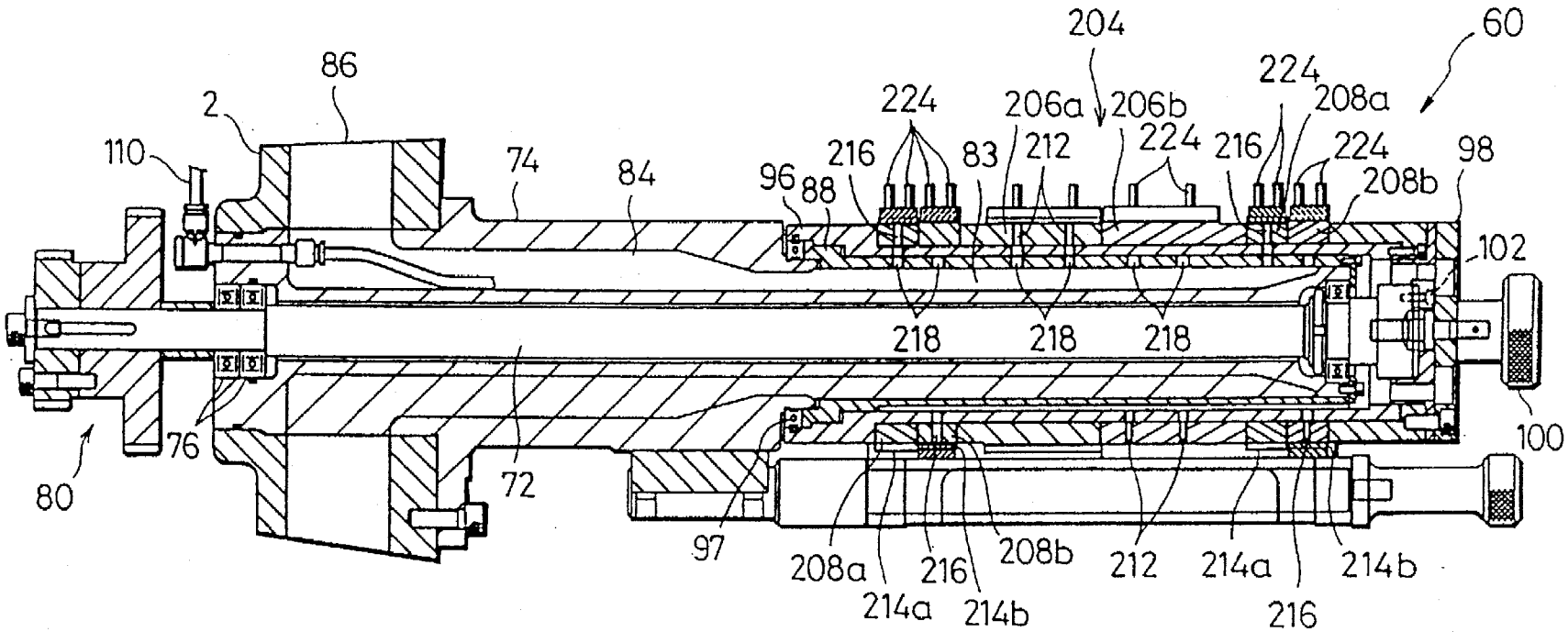
FIG. 15 is a longitudinal sectional view showing a first grading drum of FIG. 3.
Figure 16:
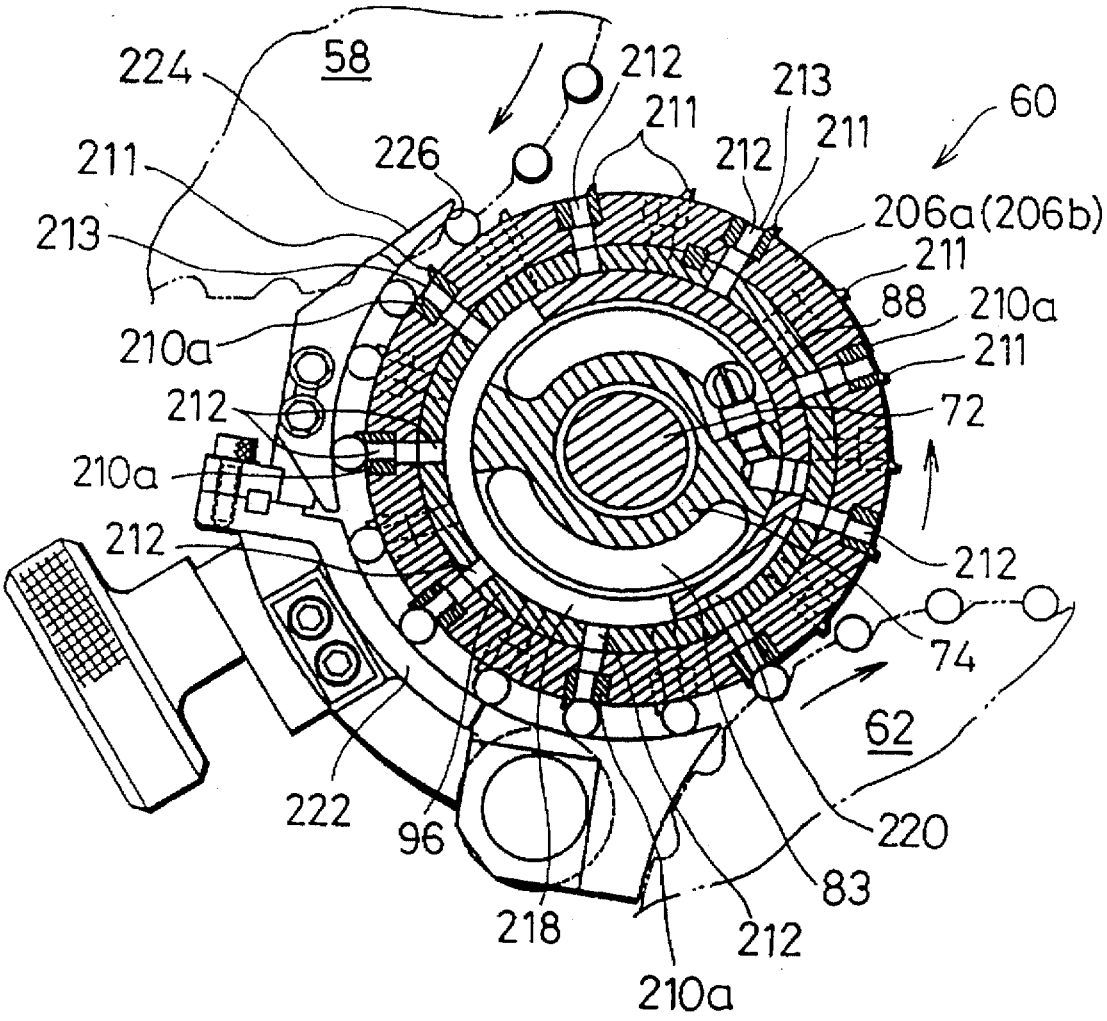
FIG. 16 is a cross-sectional view of the first grading drum of FIG. 15.

The following is a description of the first grading drum 60 which adjoins the assembly drum 58. FIGS. 15 and 16 are longitudinal and cross-sectional views, respectively, of the drum 60. A drum shell 96 of the first grading drum 60 is fitted with a grooved ring 204 on the outer peripheral surface thereof. In this case, the ring 204 includes six ring members which are arranged adjacent to each other in the axial direction of the drum shell 96. More specifically, the grooved ring 204 includes a pair of ring members 206*a* and 206*b* in its axial center and two pairs of ring members 208*a* and 208*b* which are arranged on either side of the members 206.

A large member of groove elements 210*a* and 210*b* are embedded in each of the ring members 206*a* and 206*b*. The groove elements 210*a* and 210*b* are arranged at regular intervals in the circumferential direction of the ring member 206. Each groove element 210 includes a groove 213 which is defined by two groove walls on the front and rear sides with respect to the rotating direction of the first grading drum 60. As seen from FIG. 16, the front groove wall of each groove 213 is cut off so that only the other groove wall is left as a stopper wall 211. The stopper wall 211 projects from the outer peripheral surface of the ring member 206.

The pitches between the groove elements 210 of each ring member 206 are twice as long as those between the feeding grooves 136 of the assembly drum 58. The groove elements 210*a* and 210*b* are arranged with a rotational phase difference equivalent to a half pitch in the circumferential direction of the first grading drum 60.

A pair of suction holes 212 are formed in the base of the groove 213 of each groove element 210. These suction holes 212 radially penetrate each ring member 206 and the drum shell 96 and open in the inner peripheral surface of the shell 96.

Each ring member 208 is also provided with groove elements 214*a* and 214*b* which, like the aforesaid groove elements 210, are arranged at regular intervals in the circumferential direction of the member 208. Each pair of adjacent groove elements 214*a* and 214*b* are also arranged with a rotational phase difference equivalent to a half pitch in the circumferential direction of each ring member 208. With respect to the groove elements 210 and 214 of the ring members 206 and 208, therefore, two groove elements 214*a* are situated coaxially with each of the groove elements 210*a*, and two groove elements 214*b* are situated coaxially with each of the groove elements 210*b*, as seen from FIG. 17.

One suction hole 216 is formed in the base of a groove 213 of each groove element 214. These suction holes 216 also radially penetrate each ring member 208 and the drum shell 96 and open in the inner peripheral surface of the shell 96.

As shown in FIG. 15, the outer peripheral surface of a control sleeve 88 is formed with a plurality of suction slots 218, which are situated so as to be connectable with their corresponding suction holes 212 and 216. As seen from FIG. 16, each suction slot 218 extends in the circumferential direction of the control sleeve 88, from the circumscription point between the assembly drum 58 and the first grading drum 60 to a point just short of the circumscription point between the drum 60 and the first aligning drum 62, with respect to the rotating direction of the drum 60.

Further, the outer peripheral surface of the control sleeve 88 is formed with an atmosphere groove 220. The groove 220 extends for a predetermined distance from the circumscription point between the first grading drum 60 and the first aligning drum 62 in the circumferential direction of the control sleeve 88. The groove 220 extends up to the end face of the sleeve 88 and opens into the atmosphere at this end face.

Figure 17:
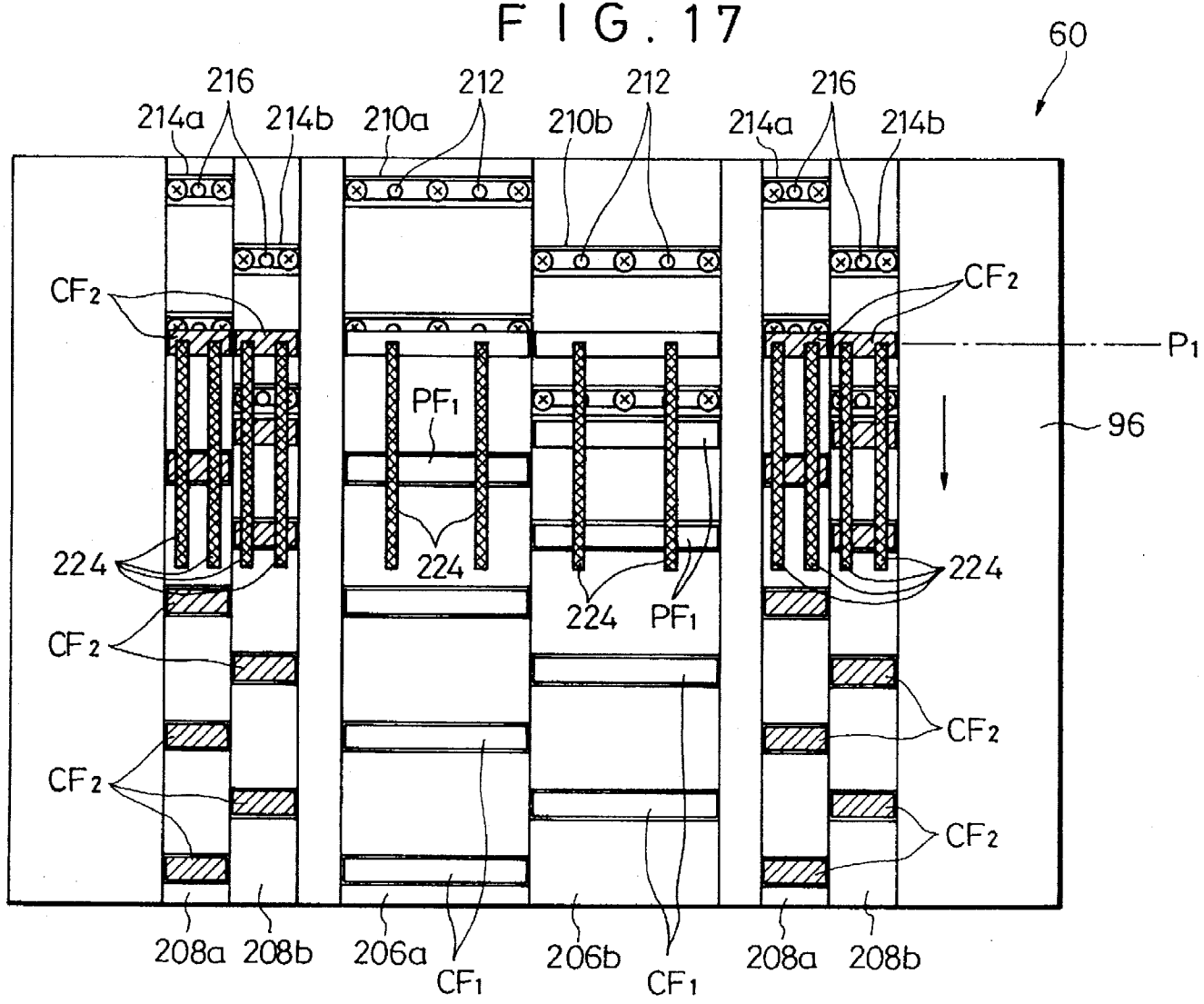
FIG. 17 is a development showing the outer peripheral surface of the first grading drum for forming dual filter plugs.

As shown in FIG. 16, moreover, the underside of the outer peripheral surface of the first grading drum 60 is covered by a cowl 222, which extends from the assembly drum 58 to the first aligning drum 62. The distal end portion of the cowl 222, which is situated on the assembly drum side, is provided with a plurality of forked claws 224. Two of the claws 224 are provided for each of the ring members 206 and 208. In FIG. 17, the claws 224 are crosshatched.

Each forked claw 224 penetrates the assembly drum 58 without hindering the rotation of the drum 58, and its distal end is situated corresponding to the circumscription point between the drum 58 and the first grading drum 60. The distal end of each forked claw 224 is formed with a guide face 226 which faces the outer peripheral surface of the first grading drum 60. The guide face 226 and the outer peripheral surface of the first grading drum 60 define a holding space, which is gradually narrowed forward in the rotating direction of the drum 60.

Since the above-described individual drums are theoretically the same peripheral speed, the filter rods half rods or plugs can transfer between each two adjacent drums. However, the peripheral speed of the first grading drum 60 is increased to a predetermined multiple of that of the assembly drum 58. More specifically, the peripheral speed ratio between the drums 58 and 60 is adjusted to a value equal to the number of the components in the first rod group to be separated in the feeding direction. To be concrete, in this case, the first grading drum 60 is rotated at a peripheral speed twice that of the assembly drum 58. To be exact, the peripheral speed of a drum is defined by that of the pitch circle of the drum, the pitch circle passing the center of each component held in each feeding groove of the drum.

According to the first grading drum 60 described above, the components (pair of plain half rods $PF_1$ in the center and pairs of charcoal plugs $CF_2$ on either side thereof) in the first rod group fed on the assembly drum 58 transfer to the first grading drum 60 at the circumscription point $P_1$ (see FIG. 18) between the drums 58 and 60. In doing this, each two adjacent components in the first rod group are separated from each other in the feeding direction.

Figure 18:
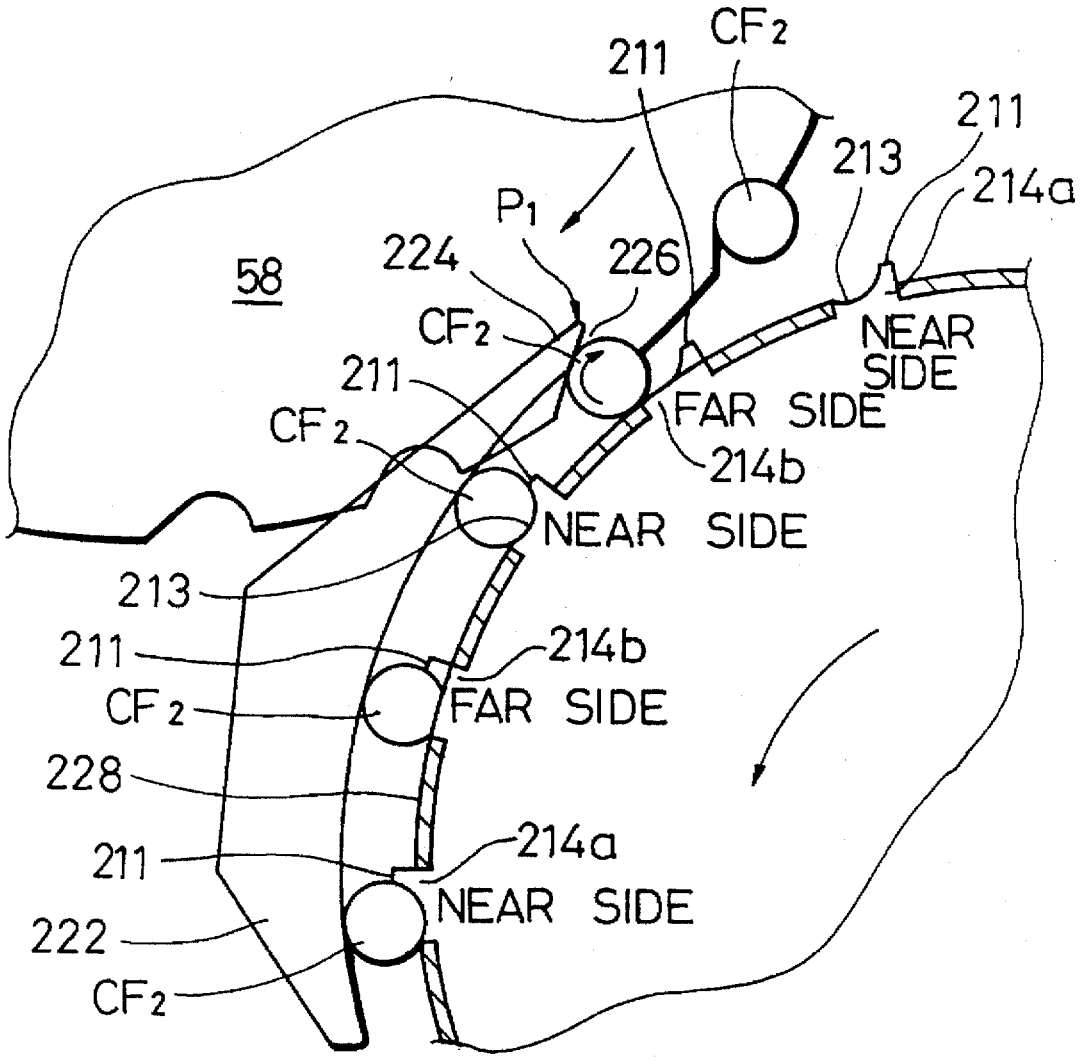
FIG. 18 is a diagram for illustrating the function of the first grading drum.

Among the components in the first rod group, each pair of adjacent charcoal plugs $CF_2$, having reached the circumscription point $P_1$, as shown in FIG. 18, are sandwiched between the outer peripheral surface of the first grading drum 60 or those of the ring members 208 and the respective guide faces 226 of the forked claws 224. Since the first grading drum 60 rotates at a peripheral speed twice that of the assembly drum 58, the pair of charcoal plugs $CF_2$ at the circumscription point $P_1$ roll on the outer peripheral surfaces of the ring members 208, as indicated by the arrow in FIG. 18, in a manner such that they are held in the holding space between the guide faces 226 and the first grading drum 60.

When the groove elements 214*a* and 214*b* of the ring members 208 reach the circumscription point $P_1$ one after another, urged by the peripheral speed difference between the assembly drum 58 and the first grading drum 60, in this state, the pair of charcoal plugs $CF_2$ are caught by the respective stopper walls 211 of their corresponding groove elements 214, whereupon they fall into the respective grooves of the groove elements 214. Thus, the charcoal plugs $CF_2$ are successively received by the groove elements 214*a* and 214*b*.

In order to help the charcoal plugs $CF_2$ or components on the ring members 208 roll smoothly and securely, the outer peripheral surface of each ring member is formed with a coating layer 228 with a high coefficient of friction or finely knurled, as shown in FIG. 18.

Since the groove elements 214, having received the charcoal plugs $CF_2$, are already connected to the suction slots 218 of the control sleeve 88 by means of the suction holes 216, thereafter, the plugs $CF_2$ in the respective grooves 213 of groove elements 214 are retained by suction.

Thus, the charcoal plugs $CF_2$ received by the groove elements 214 are caught in the grooves 213 of the elements 214. As the first grading drum 60 rotates, therefore, the charcoal plugs $CF_2$ are disengaged from the guide faces 226 of the forked claws 224, and are fed together with the groove elements 214 toward the first aligning drum 62.

The groove elements 214*a* and 214*b* of the ring members 208*a* and 208*b* are arranged with a rotational phase difference equivalent to a half pitch in the circumferential direction of each ring member 208. When the pair of charcoal plugs $CF_2$, having so far been situated coaxially with each other on the assembly drum 58, transfer to the first grading drum 60, therefore, they are separated in the feeding direction, as shown in FIG. 17.

When the remaining pair of charcoal plugs $CF_2$ and the pair of plain half rods $PF_1$ in the first rod group transfer from the assembly drum 58 to the first grading drum 60, they are also separated in the feeding direction in the same manner as aforesaid.

As a result, the components in the first rod group transfer from the assembly drum 58 to the first grading drum 60, therefore, the first rod group is divided into two second rod groups. The components in each second rod group include one plain half rod $PF_1$ and a pair of charcoal plugs $CF_2$ arranged individually on the opposite sides of the rod $PF_1$. These components are situated coaxially with one another.

The respective guide faces 226 of the forked claws 224, which serve to ensure the transfer of the components in the first rod group from the assembly drum 58 to the first grading drum 60, are not essential.

According to the first grading drum 60 described above, the components in the first rod group or the charcoal plugs and the plain half rods roll on the drum 60 as they transfer from the assembly drum 58 to the drum 60. Accordingly, the components cannot be subjected to any excessive force, and therefore, cannot be dented. Thus, the quality of the charcoal plugs and plain half rods is stabilized.

If the components are obtained form neo-filter type rod members which are formed of pulp fibers, for example, they are so poor in elasticity that their strength of stability against deformation is not high enough. Accordingly, the neo-filter rod members collapse very easily as they transfer from the assembly drum 58 to the first grading drum 60. If the neo-filter rod members roll on the drum 60 during this transfer, as mentioned before, however, they can maintain their normal appearance without being dented, despite the increase of the peripheral speeds of the drums 58 and 60. Thus, the first grading drum 60 is suited for use in higher-speed versions of filter attachments.

In some cases, the delivery of the components between the drums may become so unstable that some of the components fly away from the drums when squeezed components transfer successively from the first grading drum 60 to the subsequent drums as they are fed. Moreover, the paper piece winding operation in the wrapping section 6 may become unstable. With use of the first grading drum 60 according to the present invention, however, such an awkward situation cannot be brought about.

Figure 19:
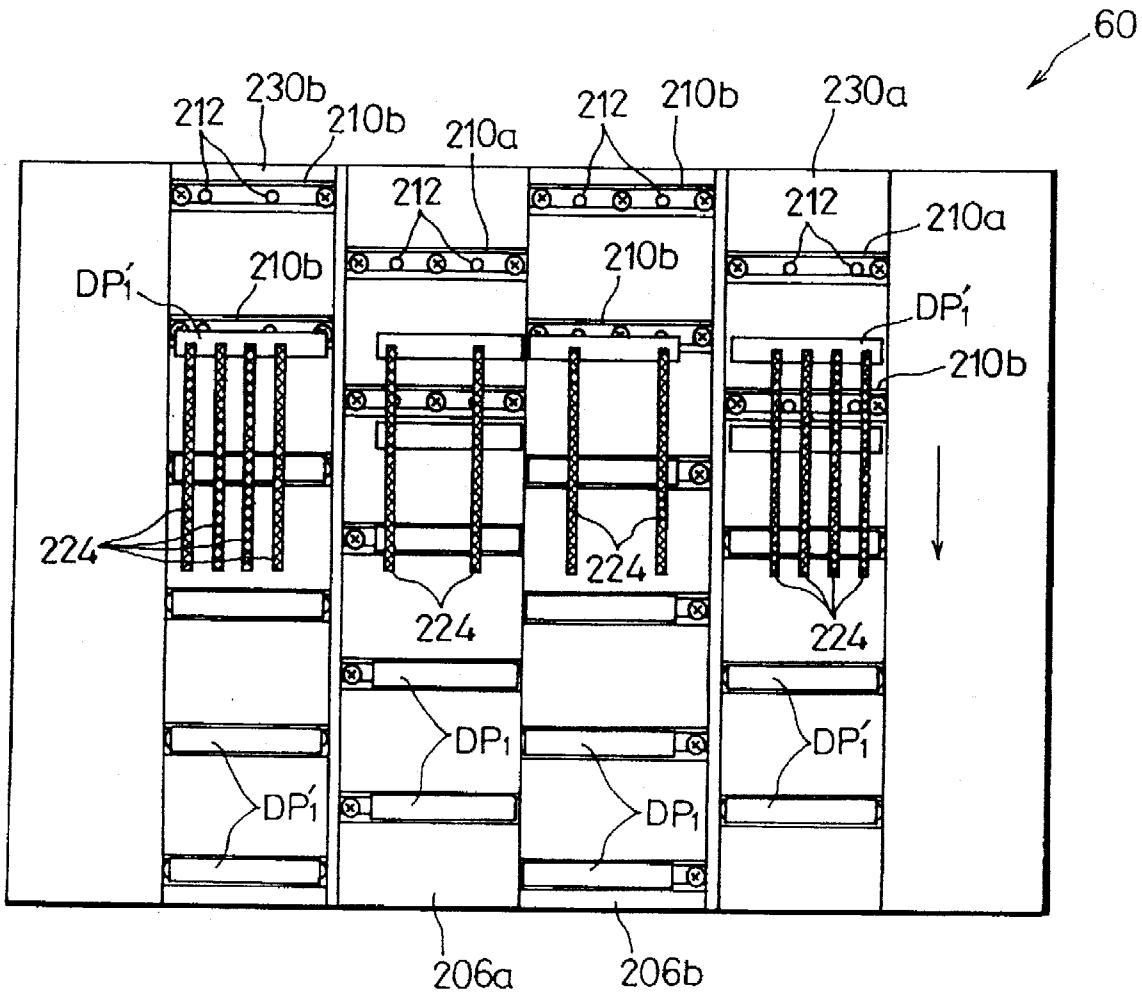
FIG. 19 is a development showing the outer peripheral surface of the first grading drum for forming non-dual filter plugs.

Referring to FIG. 19, there is shown a modification of the first grading drum 60 used in the case where the feeding apparatus 10 is applied to non-dual filter plugs. In this case, the components in the first rod group fed on the assembly drum 58 include four filter rod members of the same type, that is, plain plugs $DP_1$ and $DP'_1$. Accordingly, the first grading drum 60 is provided with a pair of ring members 206*a* and 206*b* and another pair of ring members 230*a* and 230*b* arranged on either side of the members 206. The ring members 230*a* and 230*b*, which are similar to the ring members 206, are each provided with groove elements 210*a* and 210*b* on the outer peripheral surface thereof.

When the outside pair of filter rod members or plain plugs $DP'_1$ in the first rod group transfer from the assembly drum 58 to the first grading drum 60 and are received by the groove elements 210*a* and 210*b* of the ring members 230, they are separated in the feeding direction, as seen from FIG. 19.

The objects of application of the first grading drum 60 can be changed from dual filter plugs to non-dual filter plugs by only replacing the drum shell 96 of the drum 60 together with the individual ring members.

First Aligning Drum

Figure 20:
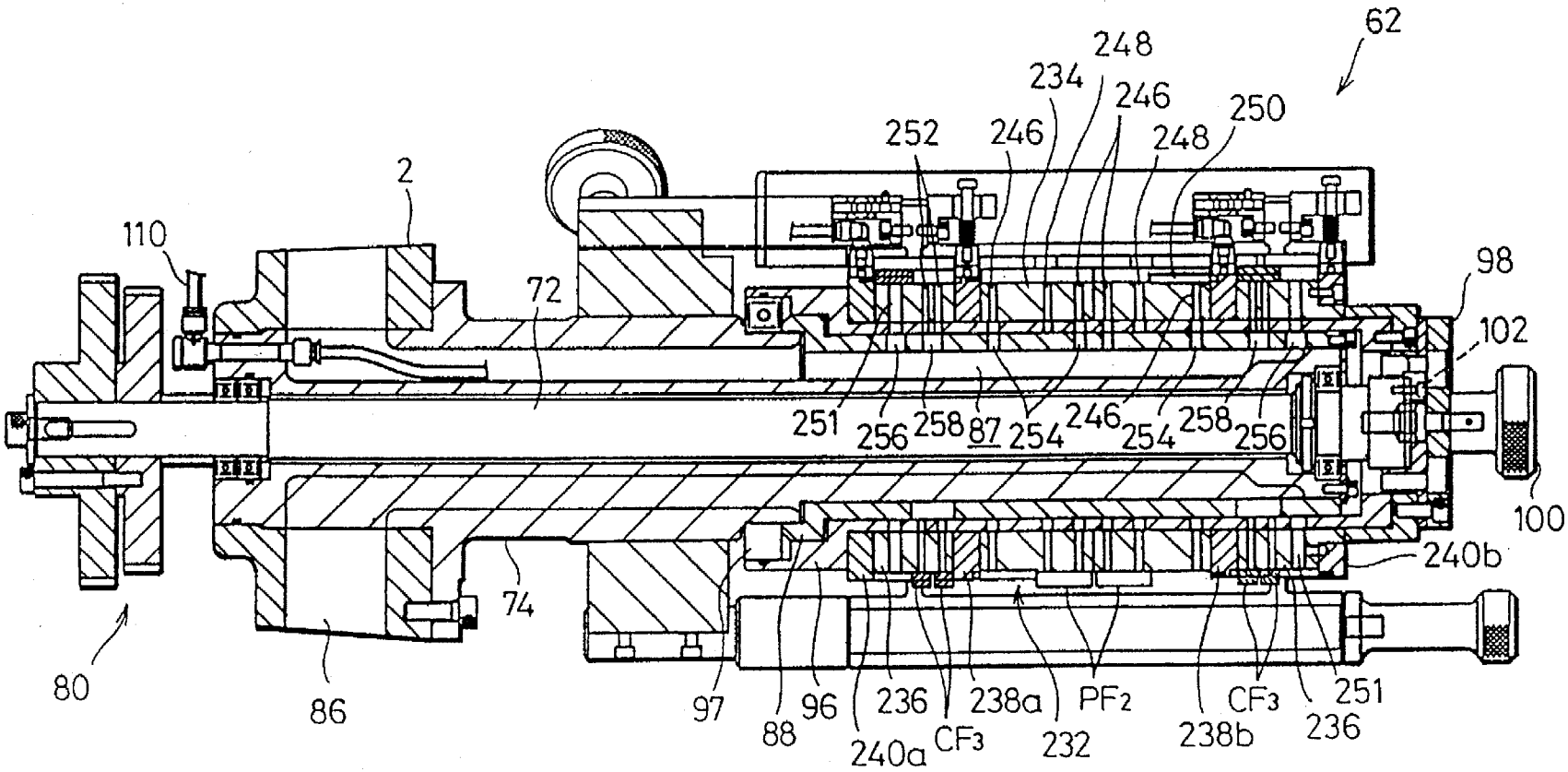
FIG. 20 is a longitudinal sectional view showing a first aligning drum of FIG. 3.

Referring to FIG. 20, there is shown a profile of the first aligning drum 62. The first aligning drum 62 has a plurality of suction chambers 87 which correspond to the suction chambers 83 of the aforementioned drums. These chambers 87 are divided in the circumferential direction of a fixed sleeve 74.

A grooved ring 232 of the first aligning drum 62 also includes a plurality of ring members, that is, a central ring member 234 and a pair of ring members 236 arranged individually on the opposite sides of the member 234.

Further, inside blow rings 238*a* and 238*b* are interposed separately between the ring members 236 and 234, and outside blow rings 240*a* and 240*b* are arranged individually on the outside of the members 236.

Figure 21:
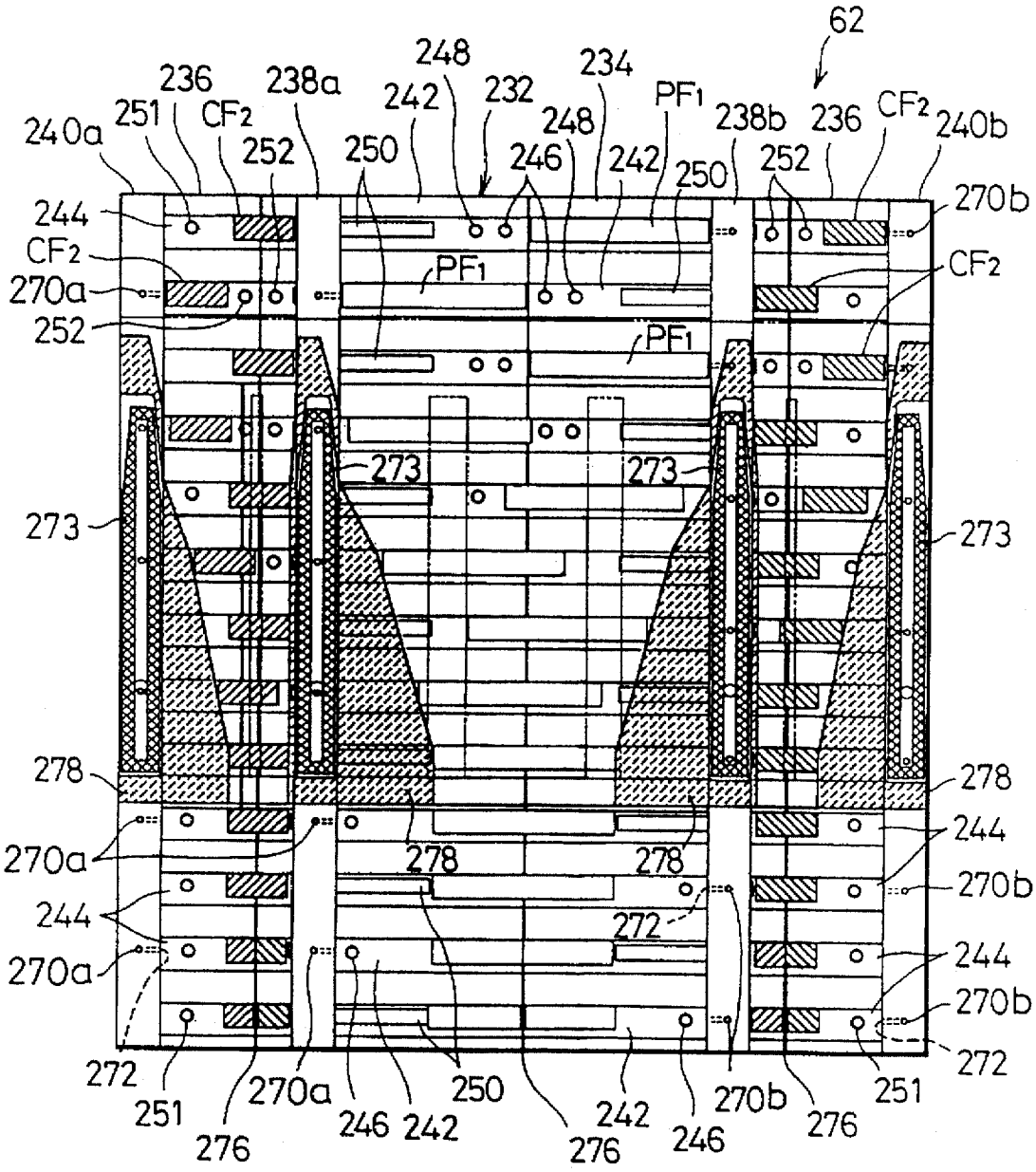
FIG. 21 is a development showing the outer peripheral surface of the first aligning drum for forming dual filter plugs.

As seen from FIG. 21, the outer peripheral surface of the central ring member 234 is provided with a large number of feeding grooves 242, which are situated at regular intervals in the circumferential direction of the member 234. The pitches between the grooves 242 are half those between the groove elements of the first grading drum 60. The outer peripheral surface of each ring member 236 is also provided with a large number of feeding grooves 244, which are situated at regular intervals in the circumferential direction of the member 236. These grooves 244 are arranged coaxially with the feeding grooves 242 of the ring member 234.

Four suction holes 246 and two suction holes 248 are formed in the base of each feeding groove 242 of the ring member 234. More specifically, supposing each feeding groove 242 is divided in two, left- and right-hand regions with respect to its axial direction, the suction holes 246 are arranged individually at the opposite ends of each region, while the suction holes 248 are distributed individually to the two regions, and are located adjacent to their corresponding inside suction holes 246. The suction holes 246 and 248 radially penetrate the ring member 234 and a drum shell 96 and open in the inner peripheral surface of the shell 96.

A stopper pin 250 is disposed in each feeding groove 242. These stopper pins 250 are alternately situated in the aforesaid left- and right-hand regions of each two adjacent feeding grooves 242, and extend for a predetermined length from their corresponding blow rings 238. The stopper pins 250 may be replaced with semicircular stopper pieces. In this case, the stopper pieces are situated in positions corresponding to the respective distal end portions of the pins 250.

Since each stopper pin 250 closes one of the suction holes 246 of each feeding groove 242, the closed suction hole 246 may be omitted.

One suction hole 251 and two suction holes 252 are formed in the base of each feeding groove 244 of the pair of ring members 236. The suction hole 251 is located at the outer end portion of the feeding groove 244, and the suction holes 252 at the inner end portion. The suction holes 251 and 252 also radially penetrate each ring member 236 and the drum shell 96 and open in the inner peripheral surface of the shell 96.

On the other hand, a control sleeve 88 is formed with a plurality of suction slots 254, which are situated so as to be connectable with their corresponding suction holes 246 of the ring member 234 as shown in FIG. 20. Further, the control sleeve 88 is formed with a plurality of suction slots 256 and a plurality of suction slots 258. Each slot 256 is situated so as to be connectable with the suction hole 251 of its corresponding ring member 236, while each slot 258 is situated so as to be connectable with the suction holes 252 of its corresponding ring member 236.

Figure 22:
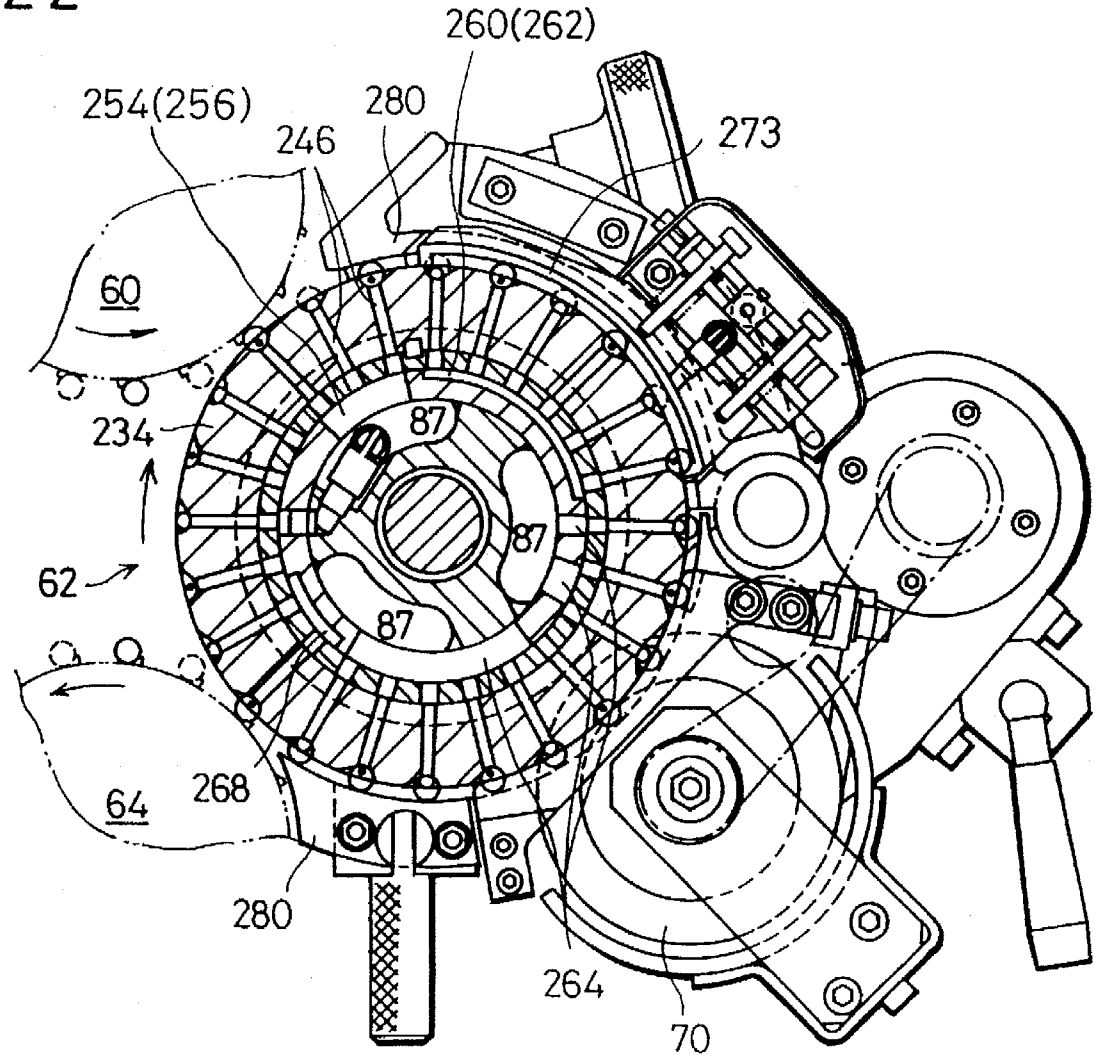
FIG. 22 is a cross-sectional view of the first aligning drum of FIG. 20.

As seen from FIG. 22, each of the suction slots 254 and 256 extends in the circumferential direction of the control sleeve 88 for a predetermined distance from the circumscription point between the first grading drum 60 and the first aligning drum 62, with respect to the rotating direction of the drum 62. On the other hand, each suction slot 258 extends from the aforesaid circumscription point to a point just short of the circumscription point between the first aligning drum 62 and the second grading drum 64. The slot 258 is not shown in FIG. 22.

As shown in FIG. 22, the outer peripheral surface of the control sleeve 88 is formed with atmosphere grooves 260 and 262, which are situated on the circumferential line of the same circle as the suction slots 256 and 258. The grooves 260 and 262 extend in the circumferential direction of the control sleeve 88 for a predetermined distance from points just ahead of the suction slots 254 and 256, with respect to the rotating direction of the first aligning drum 62.

Further, the outer peripheral surface of the control sleeve 88 is formed with a plurality of suction slots 264, which are situated so as to be connectable with the suction holes 248 of the ring member 234. The slots 264 are located in a region on the side of the second grading drum 64 with respect to the respective terminals of the atmosphere grooves 260 and 262.

Furthermore, the outer peripheral surface of the control sleeve 88 is formed with another atmosphere groove 268. The groove 268 extends in the circumferential direction of the control sleeve 88 for a predetermined distance from the circumscription point between the drum 62 and the second grading drum 64, with respect to the rotating direction of the first aligning drum 62. The atmosphere groove 268 is situated so as to be connectable with each of the suction holes 246 of the ring member 234 and the suction holes 252 of each ring member 236.

As shown in FIG. 21, the outer peripheral surface of each of the blow rings 238 and 240 is formed with a plurality of blow ports 270, which are arranged at regular intervals in the circumferential direction of the blow rings. More specifically, blow ports **270*a* of the blow rings 238*a* and 240*a* are situated corresponding to the feeding grooves 242 whose stopper pins 250 are located at a long distance from the ring 238*a* and the feeding grooves 244 which are coaxial with those grooves 242**, respectively.

The blow ports **270*a* of the blow rings 238*a* and 240*a* communicate with jet ports 272 of their corresponding blow rings. The jet ports 272 open into their corresponding feeding grooves 242 and 244 at the respective side faces of the blow rings. Likewise, blow ports 270*b* of the blow rings 238*b* and 240*b* communicate with jet ports 272** of their corresponding blow rings.

The outer peripheral surface of each of the blow rings 238 and 240 is partially covered airtight by a blow cover 273. As seen from FIG. 22, the blow covers 273 extend through a region corresponding to the atmosphere grooves 260 and 262 of the control sleeve 88, and are fixed to a support (not shown) outside the first aligning drum 62. In FIG. 21, the covers 273 are crosshatched.

Although not shown in detail, each blow cover 273 is connected to a pneumatic pressure source by means of a supply hose, whereby it is supplied with a predetermined blow pressure at all times.

The first aligning drum 62 is rotated at the same peripheral speed as the first grading drum 60. While these drums 60 and 62 are rotating, therefore, each feeding groove 242 of the first aligning drum 62 is met in succession with the feeding grooves **210*a* or 210*b* of the first grading drum 60, and each feeding groove 244 of the drum 62 with the feeding grooves 214*a* or 214*b* of the drum 60 at the circumscription point between the drums 60 and 62**.

The feeding grooves 242 and 244 of the first aligning drum 62, thus met with the feeding grooves of the first grading drum 60, are connected to the suction slots 254, 256 and 258 of the control sleeve 88 by means of the suction holes 246, 251 and 252. Accordingly, the grooves 242 and 244 can suck and receive the components in the second rod group, that is, a pair of charcoal plugs $CF_2$ and one plain half rod $PF_1$, on the first grading drum 60 by suction.

In each two adjacent feeding grooves 242 of the first aligning drum 62, as seen from FIG. 21, the plain half rods $PF_1$ are alternately situated in the left- and right-hand regions of the grooves 242. On the other hand, the pairs of charcoal plugs $CF_2$ are alternately situated in the left- and right-hand regions of each two adjacent grooves 244. This may be also seen from the arrangement of the components in the second rod group on the first grading drum 60 shown in FIG. 17.

When the rotation of the first aligning drum 62 is advanced so that the components in the second rod group on the drum 62, along with the feeding groove which holds the components, start to pass the blow covers 273, the suction holes 246 of each feeding groove 242 and the suction hole 251 of each feeding groove 244 are connected to the atmosphere grooves 260 and 262, individually. In the feeding grooves 242, therefore, the plain half rods $PF_1$ are released from suction. In the feeding grooves 244, on the other hand, only those charcoal plugs $CF_2$ which are situated in the outside portions of the groove 244, as in FIG. 21, are released from suction. The suction of each of those charcoal plugs $CF_2$ which are situated in the inside portions of the feeding grooves 244 is continued until the pair of suction holes 252 of each groove 244 concerned are connected to the atmosphere groove 268.

When the components in the second rod group, along with the feeding grooves 242 and 244, enter the region corresponding to the blow covers 273, the blow ports 270 of the blow rings 238 and 240 which correspond to the grooves 242 and 244 get into the area of the covers 273. Accordingly, a predetermined blow pressure is supplied from the blow covers 273 to the blow ports 270, and compressed air is jetted to the feeding grooves in the axial direction thereof from the jet ports 272 which are connected to the ports 270.

Figure 23:
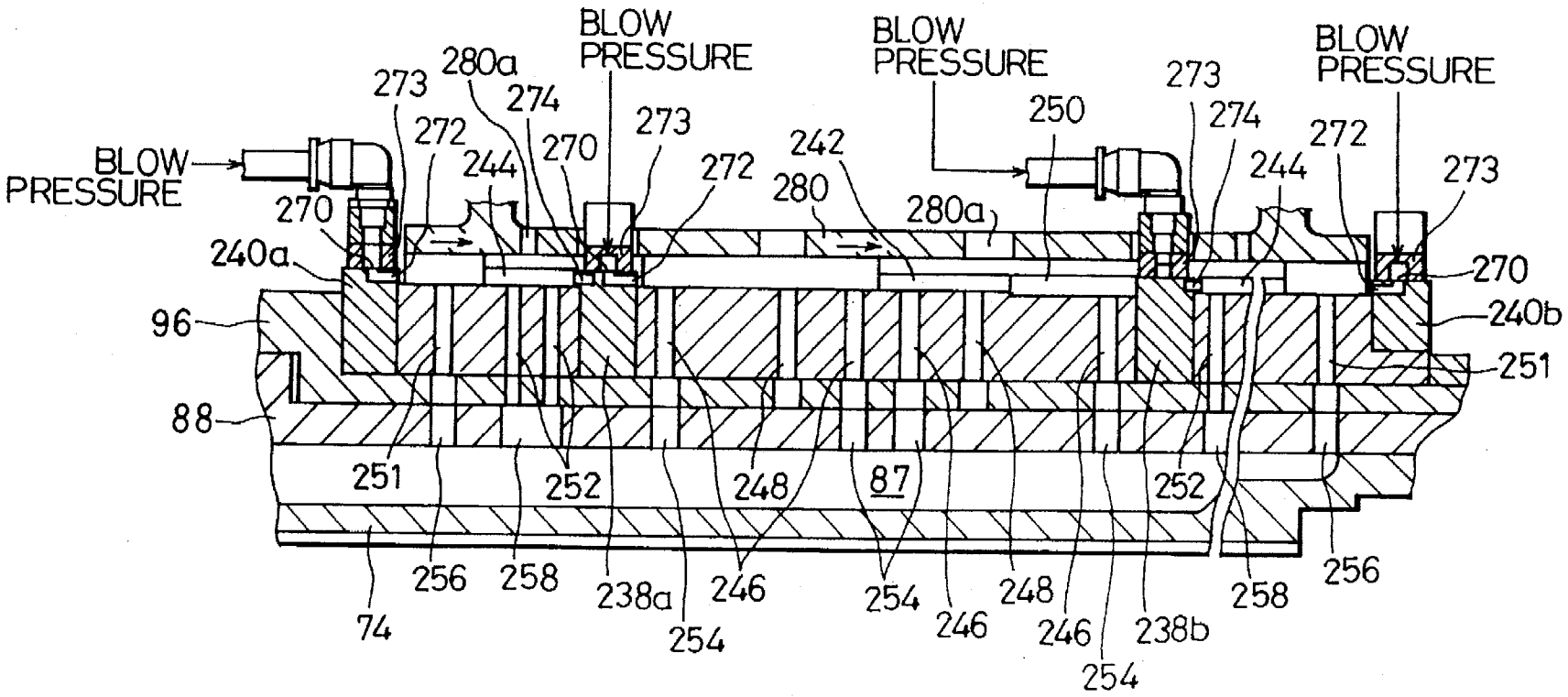
FIG. 23 is an enlarged view showing part of the first aligning drum of FIG. 20.

Thereupon, the plain half rod $PF_1$ in each feeding groove 242 is moved therein to run against the stopper pin 250 under the blow pressure from the compressed air, as seen from FIG. 23. On the other hand, the charcoal plugs $CF_2$ in the feeding grooves 244 are also moved therein toward their corresponding blow rings **238*a* and 238*b* under the blow pressure from the compressed air. A pair of stoppers 274 for the charcoal plugs $CF_2$ are attached individually to the respective side faces of the blow rings 238*a* and 238*b*, whereby the plugs $CF_2$ are drawn up on same feeding lines with those charcoal plugs $CF_2$ which adjoin them in the circumferential direction of the first aligning drum 62**.

As for the plain half rods $PF_1$, they are restrained in movement by their corresponding stopper pins 250, so that those plain half rods $PF_1$ which adjoin them in the circumferential direction of the first aligning drum 62 are also drawn up on a same feeding lines.

When the plain half rods $PF_1$ and charcoal plugs $CF_2$, along with the feeding grooves 242 and 244, pass the blow covers 273, thereafter, the grooves 242 are connected in succession to the suction slots 264 of the control sleeve 88 by means of the suction holes 248, and the two suction holes 246 in the center of each groove 242 are also connected again to the suction slots 254. Accordingly, the plain half rods $PF_1$ are fed toward the second grading drum 64 in a manner such that they are held individually in the respective central positions of the feeding grooves 242 by suction.

Meanwhile, the charcoal plugs $CF_2$ moved in the feeding grooves 244, like the other charcoal plugs $CF_2$, are fed toward the second grading drum 64 in a manner such that they are held in position by a suction pressure from the suction holes 252. This suctional holding of each plain half rod $PF_1$ and each pair of charcoal plugs $CF_2$ is continued until the suction holes 248 and 252 and the central suction hole 246 of the feeding grooves 242 and 244 concerned are connected to the atmosphere groove 268 of the control sleeve 88.

When the plain half rod $PF_1$ and the charcoal plugs $CF_2$ drawn up on the first aligning drum 62 pass the three rotary knives 70, individually, they are each cut into equal parts by the knives 70. Thereupon, two plain plugs $PF_2$ are formed from the plain half rod $PF_1$, and two charcoal tips $CF_3$ are formed from each charcoal plug $CF_2$, on the first aligning drum 62. The plugs $PF_2$ and the tips $CF_3$ are elements in the aforesaid first plug group. As shown in FIG. 21, each of the ring members 234 and 236 is formed with a circumferential groove 276, and the respective edges of the rotary knives 70 penetrate their corresponding circumferential grooves 276.

If necessary, the outer peripheral surface of the first aligning drum 62 may be formed with a plurality of orientation guides 278, such as the ones hatched by broken lines in FIG. 21. With use of these orientation guides 278, the plain half rod $PF_1$ and the charcoal plugs $CF_2$ in each feeding groove can be compulsorily moved and drawn up even though the blow pressure is not high enough.

Preferably, the orientation guides 278 should have a shape such that they can touch the rods or plugs in the feeding grooves 242 and 244 after the rods or plugs are subjected to the blow pressure. In FIGS. 22 and 23, moreover, reference numeral 280 denotes a cowl for the first aligning drum 62. The cowl 280 is formed with an opening 280*a* (FIG. 23) through which the compressed air is allowed to escape.

Figure 24:
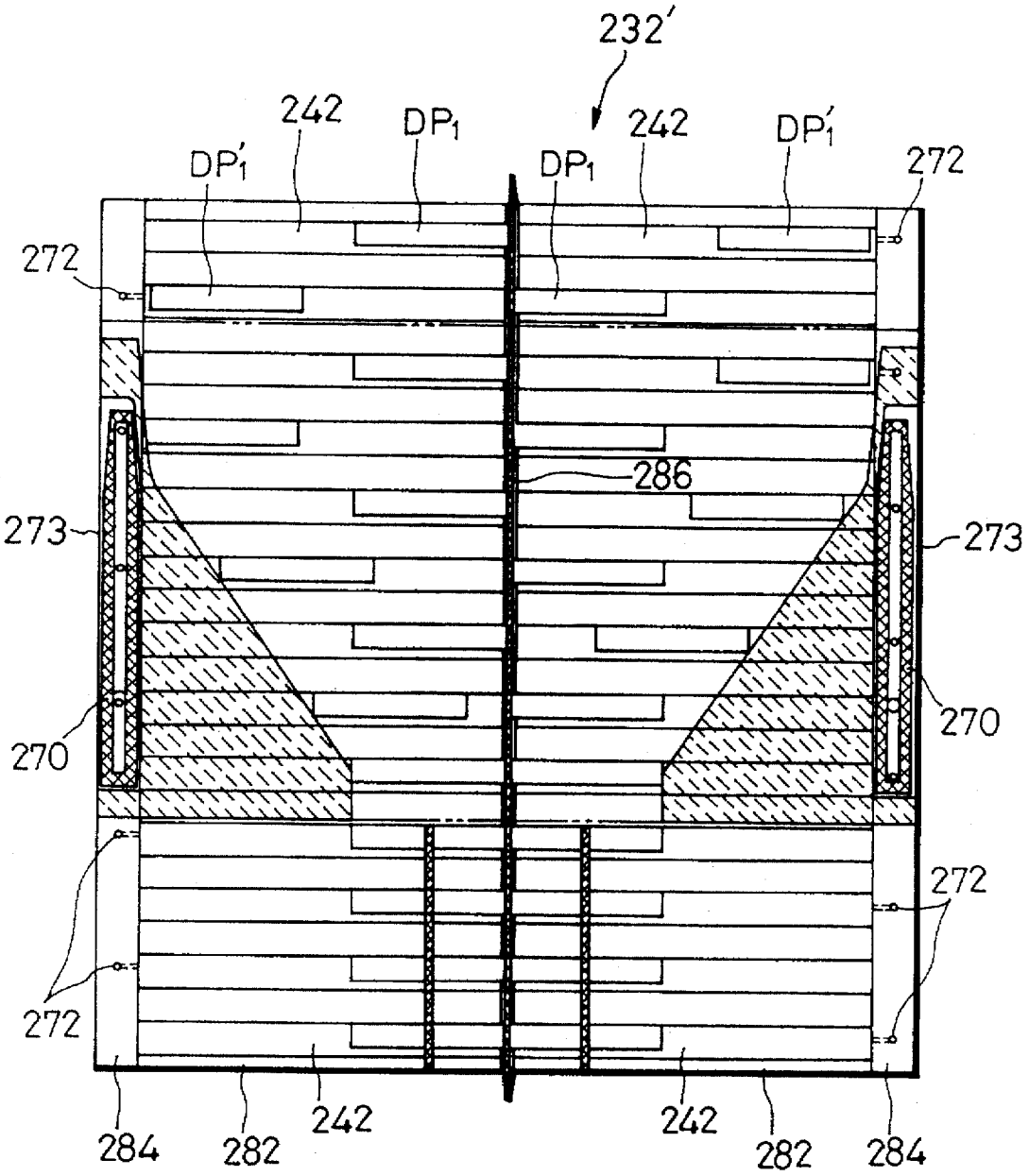
FIG. 24 is a development showing the outer peripheral surface of the first aligning drum for forming non-dual filter plugs.

In the case where the filter plug feeding apparatus 10 is used for the supply of non-dual filter plugs, the grooved ring 232 of the first aligning drum 62 shown in FIG. 22 is replaced with a grooved ring 232' shown in FIG. 24. In this case, the drum shell 96 is also replaced with one which suits the grooved ring 232'.

As shown in FIG. 24, the grooved ring 232' comprises left- and right-hand ring members 282 which resemble the aforesaid ring member 234. A pair of blow rings 284 are arranged on either side of the pair of ring members 282. In this case, a stopper ring 286 is used in place of the stopper pins 250. The stopper ring 286 is arranged at the center in the axial direction of the grooved ring 232', and is fixed to the grooved ring 232'. In FIG. 24, the suction holes of the feeding grooves 242 are omitted.

Figure 25:
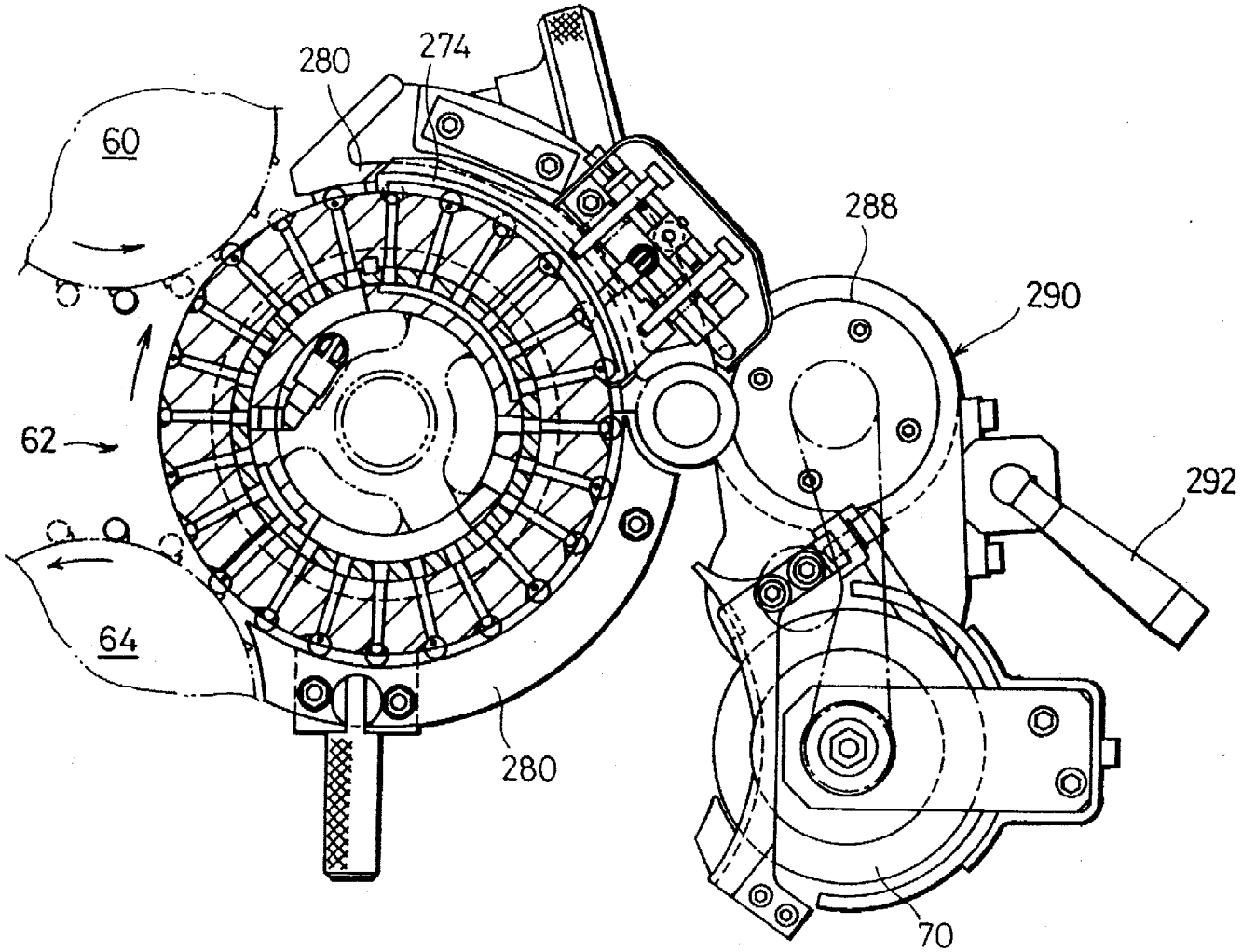
FIG. 25 is a view showing a state in which rotary knives are separated from the first aligning drum of FIG. 22.

Since the first aligning drum 62 requires none of the rotary knives 70 in this case, the knives 70 are disengaged from the drum 62, as shown in FIG. 25. More specifically, the rotary knives 70 are supported in the same manner as the aforementioned rotary knives 68, an entire knife unit 290 is rockable around a bearing sleeve 288. The knife unit 290 can be rocked by means of a handle 292. In this case, the cowl 280 of the first aligning drum 62 is replaced with a new one.

Second Grading Drum

Since the second grading drum 64 has substantially the same construction as the first grading drum 60, illustration of the drum 64 is omitted. When the elements in the first plug group fed on the first aligning drum 62 transfer to the second grading drum 64, a pair of plain plugs $PF_2$ are separated in the feeding direction, and pairs of charcoal tips $CF_3$ are also separated in the feeding direction (see FIG. 4). Thus formed on the second grading drum 64 is the aforementioned second plug group, which includes one plain plug $PF_2$ and a pair of charcoal tips $CF_3$ on either side thereof.

Second Aligning Drum

Figure 26:
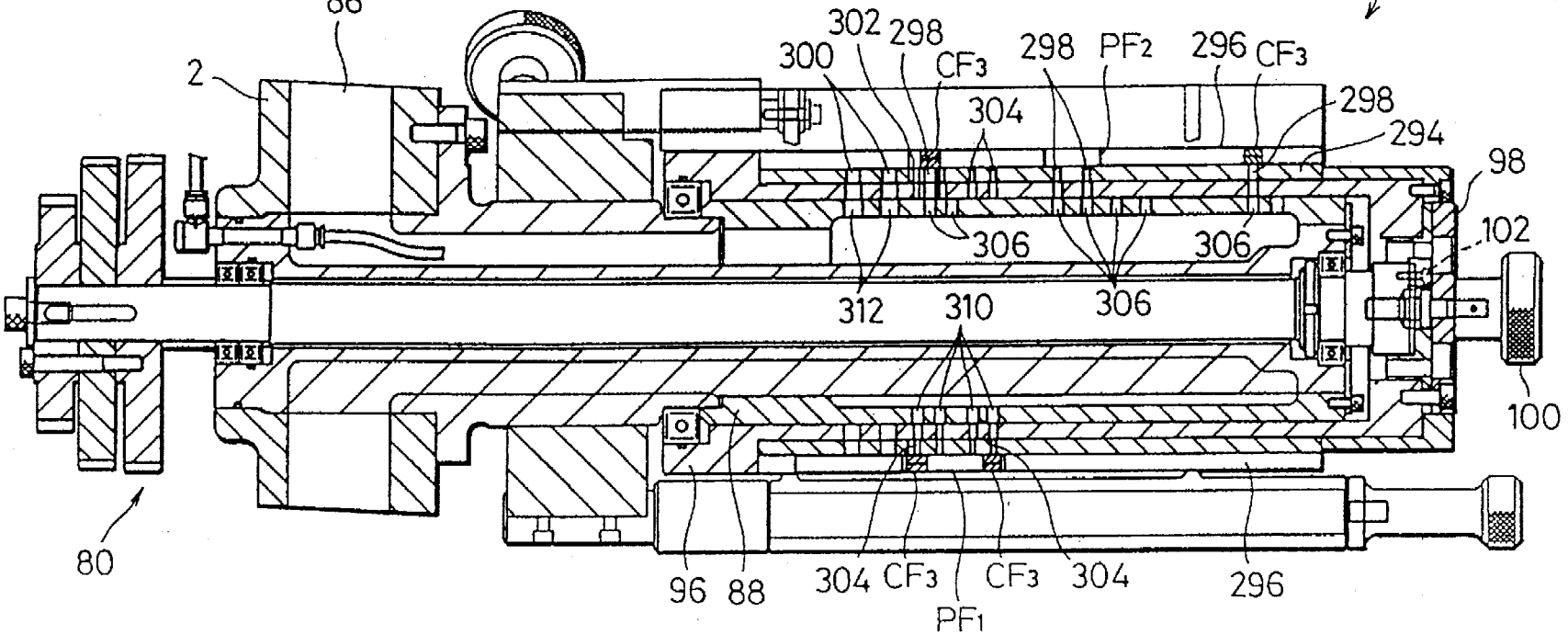
FIG. 26 is a longitudinal sectional view showing a second aligning drum of FIG. 3.

Referring to FIG. 26, there is shown a profile of the second aligning drum 66. A grooved ring 294 of the drum 66 is provided with a plurality of feeding grooves 296, which are arranged at regular intervals in the circumferential direction of the ring 294. The pitches between the feeding grooves 296 are half those between groove elements of the second grading drum 64.

Thus, when the elements in the second plug group fed on the second grading drum 64 transfer to the second aligning drum 66, these elements, that is, one plain plug $PF_2$ and two charcoal tips $CF_3$, are received by each feeding groove 296 of the drum 66. Each feeding groove 296 has a depth slightly larger than that the diameter of the tips $CF_3$ and plug $PF_2$.

A plurality of suction holes 298 are formed in the base of each feeding groove 296. These holes 298 radially penetrate the grooved ring 294 and a drum shell 96 and open in the inner peripheral surface of the shell 96. In each feeding groove 296, the suction holes 298 are located individually in positions where the plain plug $PF_2$ and the charcoal tips $CF_3$ are to be received.

As in FIG. 26, a pair of suction ports 300 are formed in the base of the left-hand end portion of each feeding groove 296. These ports 300 also radially penetrate the grooved ring 294 and the drum shell 96 and open in the inner peripheral surface of the shell 96.

The grooved ring 294 is fitted with a stopper ring 302, which divides the interior of the feeding groove 296 between a region for the formation of the pair of suction ports 300 and a region for the formation of the suction holes 298. The stopper ring 302 is formed with notches corresponding to the individual feeding grooves 296, and these notches allow the left- and right-hand regions of the grooves 296 to communicate with one another. Instead of using the stopper ring 302, a stopper may be located in each feeding groove 296.

Further, four suction holes 304 are formed in the base of each feeding groove 296, and are situated on the right of the stopper ring 302, as in FIG. 26. More specifically, two pairs of suction holes 304 are arranged individually on the opposite sides of the left-end suction hole 298 in the feeding groove 296. The suction holes 304 also radially penetrate the grooved ring 294 and the drum shell 96 and open in the inner peripheral surface of the shell 96.

On the other hand, the outer peripheral surface of a control sleeve 88 of the second aligning drum 66 is formed with a plurality of suction slots 306, which are situated so as to be connectable with their corresponding suction holes 298. As seen from FIG. 27, each of the suction slots 306 extends in the circumferential direction of the control sleeve 88 for a predetermined distance from the circumscription point between the second grading drum 64 and the second aligning drum 66, with respect to the rotating direction of the drum 66.

The outer peripheral surface of the control sleeve 88 is formed with an atmosphere groove 308, which extends beyond the circumscription point between the second aligning drum 66 and the grooved drum 5c in the drum train 4 from a point just ahead of the terminal of each suction hole 306, in the circumferential direction of the sleeve 88.

Further, the outer peripheral surface of the control sleeve 88 is formed with four suction slots 310, which are situated so as to be connectable with the suction holes 304. These slots 310 are arranged in the vicinity of the circumscription point between the second aligning drum 66 and the grooved drum 5c, and terminates at a point just short of this circumscription point.

Furthermore, the outer peripheral surface of the control sleeve 88 is formed with a pair of suction slots 312, which are situated so as to be connectable with the suction ports 300. Each of these slots 312 extends along the atmosphere groove 308 to the starting end of each suction slot 310, in the circumferential direction of the sleeve 88.

Figure 27:
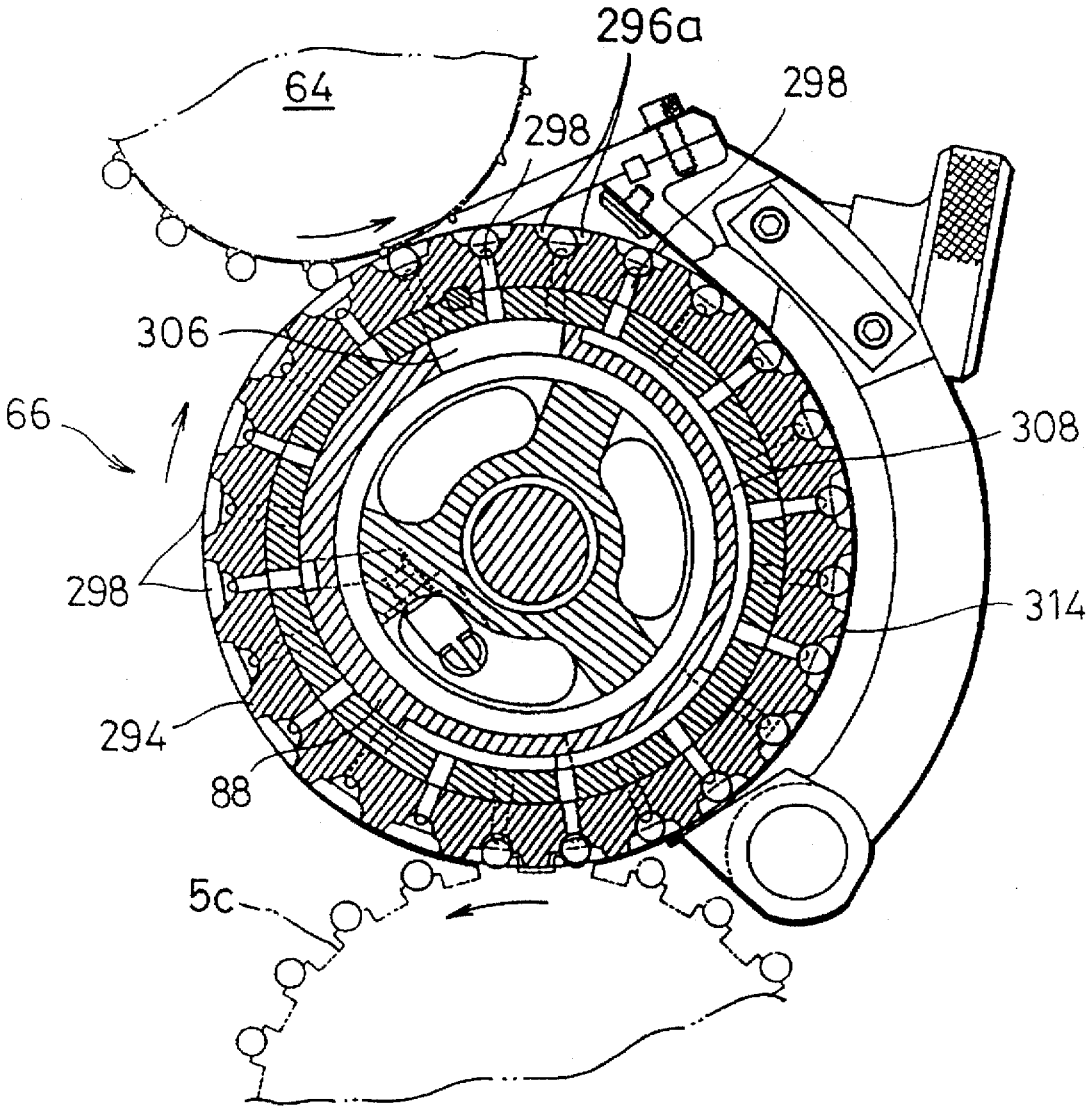
FIG. 27 is a cross-sectional view of the second aligning drum of FIG. 26.

The outer peripheral surface of the second aligning drum 66 is partially covered by a sealing sheet 314, which resembles the sealing sheets 124 for the separation drum 56 and contacts slidingly with the outer peripheral surface of the second aligning drum 66. As shown in FIG. 27, the sealing sheet 314 extends along the outer peripheral surface of the drum 66 so as to overlap the atmosphere groove 308. Thus, when each feeding groove 296 of the second aligning drum 66 passes right under the sealing sheet 314, the groove 296 and the sheet 314 form a tunnel-shaped passage.

Each feeding groove 296 of the second aligning drum 66 has a pair of leads 296a formed individually in the opposite side walls thereof. The leads 296a extend in the axial direction of the groove 296. As seen from FIG. 27, the leads 296a can be secured satisfactorily even when a plain plug $PF_2$ and charcoal tips $CF_3$ are received in the groove 296.

When the elements in the second plug group, that is, one plain plug $PF_2$ and two charcoal tips $CF_3$, fed on the second grading drum 64 reach the circumscription point between the second grading drum 64 and the second aligning drum 66, they transfer to the second aligning drum 66, and are received by each feeding groove 296 of the drum 66. At this time, the groove 296 is connected to the suction slots 306 by means of the suction holes 298.

Figure 28:
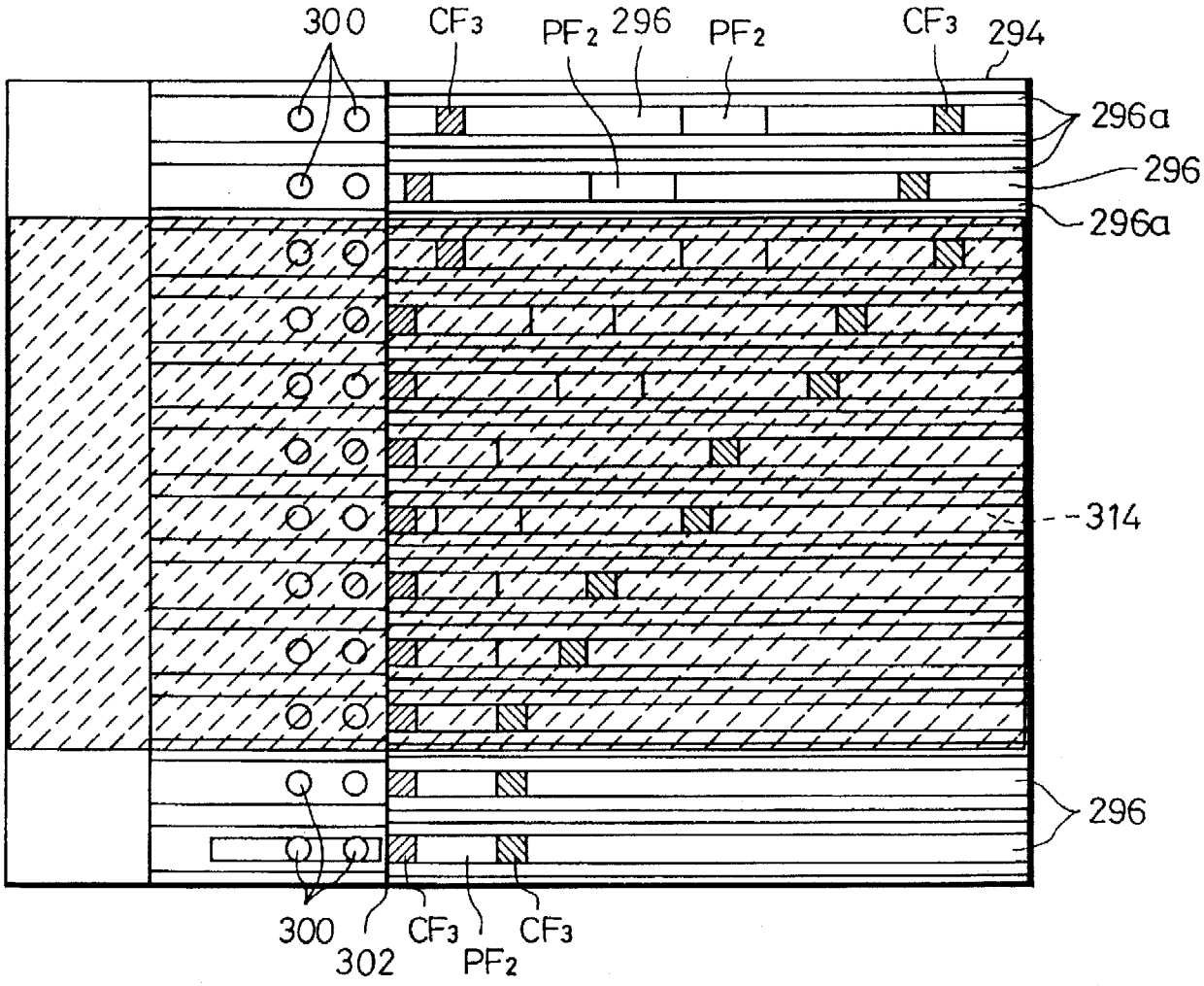
FIG. 28 is a development showing the outer peripheral surface of the second aligning drum for forming dual filter plugs.

The elements in the second plug group, transferring successively from the second grading drum 64 to the second aligning drum 66, are received in different positions in the individual feeding grooves 296 which adjoin one another in the circumferential direction of the drum 66, as seen from FIG. 28. This is ensured by the function of the second grading drum 64.

When the rotation of the second aligning drum 66 is advanced so that the feeding groove 296 which holds the elements in the second plug group reaches the area of the atmosphere groove 308, the groove 296 is connected to the groove 308 by means of the suction holes 298. At this time, the plain plug $PF_2$ and the charcoal tips $CF_3$ in the feeding groove 296 are released from suction.

Thereupon, the pair of suction ports 300 of the feeding groove 296 are connected to the suction slots 312, individually, and the groove 296 enters the area of the sealing sheet 314. Accordingly, the suction ports 300 suck out air from the tunnel-shaped feeding groove 296, so that air currents directed to the ports 300 are produced in the leads 296a of the groove 296.

As shown in FIG. 28, therefore, the plain plug $PF_2$ and the charcoal tips $CF_3$ held in the feeding groove 296 are moved in the groove 296 toward the stopper ring 302 by the air currents in the leads 296a, and are drawn out abutting against one another on the right of the ring 302. Thus, the aforementioned dual filter plug is formed on the second aligning drum 66.

When the rotation of the second aligning drum 66 is further advanced, the feeding groove 296 which holds the dual filter plug is connected to the suction holes 310 of the control sleeve 88 by means of the suction holes 304, and the dual filter plug is fed toward the grooved drum 5c of the drum train 4 in a manner such that it is sucked in position in the groove 296. Thereafter, the dual filter plug on the second aligning drum 66 transfers to the grooved drum 5c, and is transported on the drum train 4 toward the wrapping section 6.

According to the second aligning drum 66 described above, the air currents are produced in the leads 296a of each feeding groove 296. Even though the elements in the second plug group received in the groove 296 includes one plain plug $PF_2$ and two charcoal tips $CF_3$, therefore, they can move securely and steadily in the groove 296, borne by the air currents in the leads 296a, and be drawn out on the right of the stopper ring 302.

The charcoal tips $CF_3$, as the elements of the dual filter plug, are so short that they are liable to rise as they move in the feeding groove 296. On the second aligning drum 66, however, the charcoal tips $CF_3$ are moved by the air currents on the opposite sides of the groove 296, so that they will never rise in the groove 296 during the movement. Thus, the plain plug $PF_2$ and the charcoal tips $CF_3$ can be steadily drawn up in the feeding groove 296, so that the dual filter plug can be formed securely.

If the formation of the dual filter plug in the feeding groove 296 is imperfect, the dual filter plug may fail securely to transfer from the second aligning drum 66 to the grooved drum 5c in the drum train 4, possibly slipping out of the groove 296 or jamming therein. In some cases, therefore, the operation of the filter attachment may be interrupted. According to the second aligning drum 66 described above, however, such an awkward situation cannot be brought about.

Figure 29:
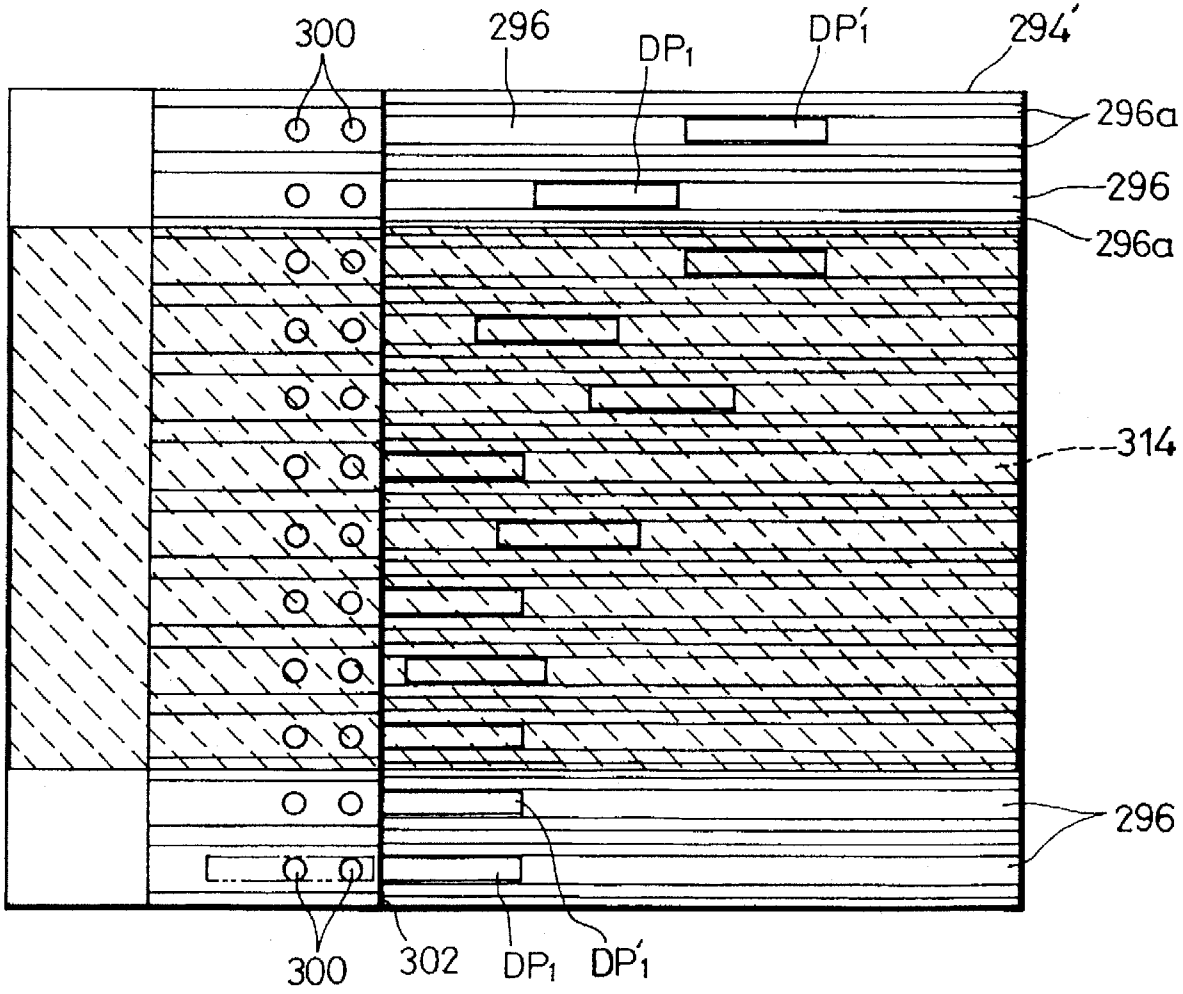
FIG. 29 is a development showing the outer peripheral surface of the second aligning drum for forming non-dual filter plugs.

In the case where the filter plug feeding apparatus 10 is used for the supply of non-dual filter plugs, the second aligning drum 66 is replaced with another grooved ring 294', as shown in FIG. 29. In this case, the arrangement of suction holes 298 of each feeding groove 296 in the grooved drum 294' is changed depending on the positions where the plain filter plugs $DP_1$ and $DP'_1$ are received.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A filter plug feeding apparatus for a filter cigarette manufacturing machine which has a transportation path along which cigarettes are transported in pairs, each pair of cigarettes on the transportation path being situated coaxially with each other and extending at right angles to the transportation path, said feeding apparatus comprising:

first and second hoppers stored with filter rods and each having a discharge port through which the filter rods are discharged;

a drum train for connecting the transportation path and the respective discharge ports of the first and second hoppers to form filter plugs from the filter rods in said first and second hoppers and feed the formed filter plugs to the transportation path, said drum train including a separating drum section having a first feeding line for connecting the discharge port of said first hopper with the transportation path, the first feeding line delivering first-type filter rods one by one from the discharge port of said first hopper and feeding the delivered first-type filter rods, first cutting means for equally cutting each first-type filter rod into a pair of first-type half rods on the first feeding line, and separating means for separating each pair of first-type half rods from each other in the axial direction thereof on the first feeding line, and a joining drum section having a second feeding line for connecting the discharge port of said second hopper with the first feeding line, the second feeding line delivering second-type filter rods one by one from the discharge port of said second hopper and feeding the delivered second-type filter rods on the separating drum section, second cutting means for equally cutting each second-type filter rod into a pair of second-type half rods in the process of the feeding thereof so that each pair of second-type half rods are situated between a respective pair of first-type filter rods on the separating drum section, whereby first rod groups are formed on the separating drum section, each first rod group having a pair of second-type half rods and a pair of first-type half rods located on the opposite sides thereof; and adapting means for forming one of dual filter plugs and non-dual filter plugs in the process wherein the first-type half rods and second-type half rods are fed on the first feeding line, the dual filter plug having a center element made of the second-type half rod and a pair of tip elements made of the first-type half rod and situated individually on the opposite sides thereof, and the non-dual filter plug having an element made of one of the first-type half rod and the second-type half rod, said adapting means including third cutting means for cutting each of the first-type half rods on the separating drum section into a pair of first-type plugs, the third cutting means having two rotary knives, a supporting arm disposed for rocking motion above the first feeding line and rotatably supporting the rotary knives and a power transmission path for transmitting power to the rotary knives.

2. The apparatus according to claim 1, wherein said adapting means further includes centering means for locating the respective axial centers of the filter rods on the first and second feeding lines, respectively, when the filter rods are delivered from said first and second hoppers onto the drum train.

3. The apparatus according to claim 2, wherein said centering means includes a pair of hopper walls for defining the discharge port of said hopper, the pair of hopper walls facing each other and being movably arranged toward and away from each other so that the size of the discharge port of said hopper in the lengthwise direction of the filter rods is varied, and the center of the discharge port is situated on the feeding line corresponding thereto.

4. The apparatus according to claim 1, wherein the separating drum section further includes a first hopper drum rotatably disposed adjacent to the discharge port of said first hopper and adapted to deliver the first-type filter rods one by one from said first hopper;

the first cutting means includes a rotary knife attached to said first hopper drum and adapted to cut each of the delivered first-type filter rods into a pair of first-type half rods on the first hopper drum;

the separating means includes a separation drum rotatably disposed adjacent to the first hopper drum and adapted to receive the pair of first-type half rods from the first hopper drum, the received first-type half rods being separated from each other on the separation drum;

the separating drum section further includes an assembly drum rotatably disposed adjacent to the separation drum and adapted to receive the pair of first-type half rods from the separation drum;

the joining drum section includes a second hopper drum rotatably disposed adjacent to both the discharge port of said second hopper and the assembly drum and adapted to deliver the second-type filter rods one by one from said second hopper; and the second cutting means includes a rotary knife attached to said second hopper drum and adapted to cut each of the delivered second-type filter rods into a pair of second-type half rods on the second hopper drum.

5. The apparatus according to claim 1, wherein the third cutting means further includes a coupling provided in the power transmission path and separably connecting an upper stream side portion and a lower stream side portion of the power transmission path, the lower stream side portion of the transmission path having the rotary knives.

6. The apparatus according to claim 1, wherein said drum train further includes grading means for receiving the first rod groups from the separating drum section, separating each of the first rod groups into two second rod groups in the feeding direction thereof, the two second rod groups having same components, respectively, and feeding the second rod groups, and orientation means for receiving each of the second rod groups and drawing up the components in the received second rod group.

7. The apparatus according to claim 6, wherein the grading means includes a rotatable grading drum connected to the separating drum section, and the orientation means includes an aligning drum rotatably located adjacent to the grading drum, the respective outer peripheral surfaces of the grading drum and the aligning drum constituting part of the first feeding path for the components in the first and second rod groups.

8. The apparatus according to claim 7, wherein each of the drum includes a fixed sleeve, a rotatable drum shell removably mounted on the outer peripheral surface of the sleeve, and a grooved ring fixedly mounted on the outer peripheral surface of the drum shell, the grooved ring having on the outer peripheral surface thereof a plurality of feeding grooves capable of receiving the components in the first or second rod groups to be fed.

9. The apparatus according to claim 8, wherein each of the drum further includes suction means for retaining the components in the feeding grooves by suction, the suction means having a plurality of suction slots formed in the outer peripheral surface of the sleeve and adapted to supplied with a suction pressure and a plurality of suction holes each having one end opening in a base of each of the feeding groove and the other end connectable with each corresponding suction slot, the suction holes radially extending in the drum shell and the grooved ring.

10. The apparatus according to claim 6, wherein said drum train further includes a third drum section for feeding the component in the second rod group drawn up by the orientation means to the transportation path; said adapting means further includes fourth cutting means for equally cutting each of the components in the second rod group into equal numbers, respectively, so that the second rod group is divided into first plug groups on the third drum section, the fourth cutting means having a plurality of rotary knives, a supporting arm disposed for rocking motion above the third drum section and rotatably supporting the rotary knives and a power transmission path for transmitting power to the rotary knives;

second grading means for separating each of the first rod groups into a plurality of plug form in the feeding direction; and second orientation means for receiving the plug form and drawing up the plug form.

* * * * *